US011478846B2

(12) United States Patent
Okada

(10) Patent No.: US 11,478,846 B2
(45) Date of Patent: Oct. 25, 2022

(54) ELECTROMAGNETIC STIRRING DEVICE

(71) Applicant: NIPPON STEEL CORPORATION, Tokyo (JP)

(72) Inventor: Nobuhiro Okada, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 17/052,124

(22) PCT Filed: Apr. 24, 2019

(86) PCT No.: PCT/JP2019/017427
§ 371 (c)(1),
(2) Date: Oct. 30, 2020

(87) PCT Pub. No.: WO2019/216222
PCT Pub. Date: Nov. 14, 2019

(65) Prior Publication Data

US 2021/0138534 A1 May 13, 2021

(30) Foreign Application Priority Data

May 8, 2018 (JP) ..... JP2018-090208

(51) Int. Cl.
*B22D 11/115* (2006.01)
*B22D 11/053* (2006.01)
(Continued)

(52) U.S. Cl.
CPC ..... *B22D 11/115* (2013.01); *B01F 33/451* (2022.01); *B22D 11/053* (2013.01); *B01F 2101/45* (2022.01)

(58) Field of Classification Search
CPC ..... B22D 11/115; B22D 11/053; B22D 11/04; B22D 11/122
See application file for complete search history.

(56) References Cited

U.S. PATENT DOCUMENTS

2003/0183363 A1* 10/2003 Lehman ..... B22D 11/115 164/468

FOREIGN PATENT DOCUMENTS

CN 105728679 A * 7/2016
JP 58-215250 A 12/1983
(Continued)

OTHER PUBLICATIONS

English Machine Translation of CN 105728679 A (Year: 2016).*

*Primary Examiner* — Kevin P Kerns
*Assistant Examiner* — Steven S Ha
(74) *Attorney, Agent, or Firm* — Birch, Stewart, Kolasch & Birch, LLP

(57) ABSTRACT

This electromagnetic stirring device configured to apply an electromagnetic force which generates a swirling flow around a vertical axis to molten metal in a mold by generating a rotating magnetic field in the mold, which is a quadrangular tubular mold for continuous casting, the electromagnetic stirring device provided with an iron core enclosing the mold at a side of the mold and including two teeth arranged side by side in a circumferential direction of the mold so as to face an outer side surface for each of outer side surfaces of the mold, coils wound around the respective teeth of the iron core, and a power supply device which applies an alternating current to each of the coils with a phase shift by 90° in arrangement order of the coils so as to generate the rotating magnetic field.

2 Claims, 16 Drawing Sheets

(51) Int. Cl.
*B01F 33/451* (2022.01)
*B01F 101/45* (2022.01)

(56) References Cited

FOREIGN PATENT DOCUMENTS

| | | | |
|---|---|---|---|
| JP | 63-252651 | A | 10/1988 |
| JP | 4-9255 | A | 1/1992 |
| JP | 6-304719 | A | 11/1994 |
| JP | 2008-137031 | A | 6/2008 |
| JP | 2009-209398 | A | 9/2009 |
| JP | 2011-1631 | A | 1/2011 |

* cited by examiner

ELECTROMAGNETIC STIRRING DEVICE

TECHNICAL FIELD OF THE INVENTION

The present invention relates to an electromagnetic stirring device.

The present application claims priority based on Japanese Patent Application No. 2018-090208 filed in Japan on May 8, 2018, and the content thereof is incorporated herein.

RELATED ART

In continuous casting, by injecting molten metal (for example, molten steel) temporarily stored in a tundish from above into a quadrangular tubular mold through an immersion nozzle, and pulling a bloom of which outer peripheral surface is cooled there to be solidified from a lower end of the mold, casting is continuously performed. A solidified portion of the outer peripheral surface of the bloom is referred to as a solidified shell.

Herein, the molten metal in the mold contains gas bubbles of an inert gas (for example, Ar gas) supplied together with the molten metal to prevent clogging of a discharge hole of the immersion nozzle, non-metallic inclusions and the like; if these impurities remain in the bloom after casting, this causes deterioration in quality of a product. Meanwhile, in this specification, in a case where it is simply referred to as a quality of a bloom, this means at least one of a surface quality of the bloom or an inner quality (inner quality) of the bloom.

Generally, a specific gravity of impurities such as gas bubbles and non-metallic inclusions is smaller than the specific gravity of the molten metal, so that the impurities are often floated in the molten metal to be removed during continuous casting; however, in order to further improve a quality of the bloom, an electromagnetic stirring device is widely used as a technology for more effectively removing these impurities from the molten metal in the mold.

The electromagnetic stirring device is a device which generates a moving magnetic field in the mold, thereby applying an electromagnetic force referred to as a Lorentz force to the molten metal in the mold to generate a flow pattern which swirls in a horizontal plane (that is, a swirling flow around a vertical axis) in the molten metal. Since the swirling flow is generated by the electromagnetic stirring device, the flow of the molten metal at a solidified shell interface is accelerated, so that the above-described impurities such as gas bubbles and non-metallic inclusions are suppressed from being trapped in the solidified shell, and a quality of the bloom may be improved. Furthermore, since the swirling flow generated in the molten metal in the mold makes temperature of the molten metal in the mold uniform, an initial solidification position is stabilized, so that it is possible to suppress occurrence of a crack in the bloom.

Specifically, the electromagnetic stirring device includes an iron core arranged at a side of the mold and a coil wound around the iron core. A moving magnetic field may be generated in the mold by application of an alternating current to the coil of the electromagnetic stirring device. For example, Patent Document 1 discloses an electromagnetic stirring device in which an iron core around which a coil is wound is arranged only at a side of an outer side surface on a long side of a mold. For example, Patent Document 2 discloses an electromagnetic stirring device in which one magnetic pole portion formed of the teeth provided on an iron core and a coil wound around the teeth is arranged for each outer side surface. For example, Patent Document 3 discloses an electromagnetic stirring device including an annular iron core enclosing a mold at a side of the mold, and a coil wound around the iron core around an axis in the same direction as a direction in which the iron core extends.

CITATION LIST

Patent Document

[Patent Document 1]
Japanese Unexamined Patent Application, First Publication No. S63-252651
[Patent Document 2]
Japanese Unexamined Patent Application, First Publication No. H6-304719
[Patent Document 3]
Japanese Unexamined Patent Application, First Publication No. S58-215250

SUMMARY OF INVENTION

Problems to be Solved by the Invention

However, in the technology disclosed in Patent Document 1, since the iron core around which the coil is wound is arranged only at the side of the outer side surface on the long side of the mold, in a case where a difference between the long side and the short side of the mold is relatively small, it is difficult to sufficiently generate a swirling flow around a vertical axis in molten metal in the mold. Specifically, in continuous casting which manufactures a bloom, the difference between the long side and the short side of the mold is relatively small (for example, the short side is 50% to 80% of the long side in length), so that it becomes difficult to sufficiently generate the swirling flow around the vertical axis.

In the technology disclosed in Patent Document 2, although the magnetic pole portion is arranged not only at the side of the outer side surface on the long side of the mold but also at the side of the outer side surface on the short side of the mold, a flow in a vertical direction might occur in the molten metal in the mold. Specifically, an eddy current is generated in a mold plate when a magnetic flux horizontally enters the mold plate forming the outer side surface of the mold from the magnetic pole portion. By the eddy current generated in the mold plate in this manner, in a magnetic field generated by the magnetic pole portion, the magnetic flux horizontally entering the mold plate from the magnetic pole portion is weakened, and a leakage flux including a vertical component is generated. As a result, an electromagnetic force in the vertical direction is applied to the molten metal in the mold, so that the flow in the vertical direction might occur.

Herein, when the flow in the vertical direction remarkably occurs, gas bubbles, non-metallic inclusions, and further molten powder floating on a bath level are caught in the molten metal, so that a defect caused by them might occur. Furthermore, due to occurrence of the flow in the vertical direction, temperature of the molten metal in the mold becomes nonuniform, and an initial solidification position is unstable, so that there is a possibility of occurrence of a crack in the bloom.

The technology disclosed in Patent Document 3 requires the step of winding the coil around the iron core around the axis in the same direction as the extending direction of the iron core forming a closed loop when manufacturing the electromagnetic stirring device, so that it might be difficult to manufacture the electromagnetic stirring device. Therefore, further proposals for the electromagnetic stirring device are desired.

Therefore, the present invention is achieved in view of the above-described problem, and an object thereof is to provide an electromagnetic stirring device capable of appropriately generating a swirling flow around a vertical axis while suppressing a flow in a vertical direction in molten metal in a mold in which a need for a step of winding the coil around the iron core around the axis in the same direction as the direction in which the iron core forming the closed loop extends at the time of manufacturing is eliminated.

Means for Solving the Problem (1) One aspect of the present invention is an electromagnetic stirring device configured to apply an electromagnetic force which generates a swirling flow around a vertical axis to molten metal in a mold by generating a rotating magnetic field in the mold, which is a quadrangular tubular mold for continuous casting. The electromagnetic stirring device is provided with an iron core enclosing the mold at a side of the mold and including two teeth arranged side by side in a circumferential direction of the mold so as to face an outer side surface for each of outer side surfaces of the mold, coils wound around the respective teeth of the iron core, and a power supply device which applies an alternating current to each of the coils with a phase shift by 90° in arrangement order of the coils so as to generate the rotating magnetic field.

(2) In the electromagnetic stirring device disclosed in (1) above, the power supply device may apply an alternating current of 1.0 Hz to 4.0 Hz to each of the coils.

Effects of the Invention

According to the above-described electromagnetic stirring device, it becomes possible to appropriately generate the swirling flow around the vertical axis while suppressing the flow in the vertical direction in the molten metal in the mold in which the need for a step of winding the coil around the iron core around the axis in the same direction as the direction in which the iron core forming the closed loop extends at the time of manufacturing is eliminated.

EMBODIMENT OF THE INVENTION

Figure 1:
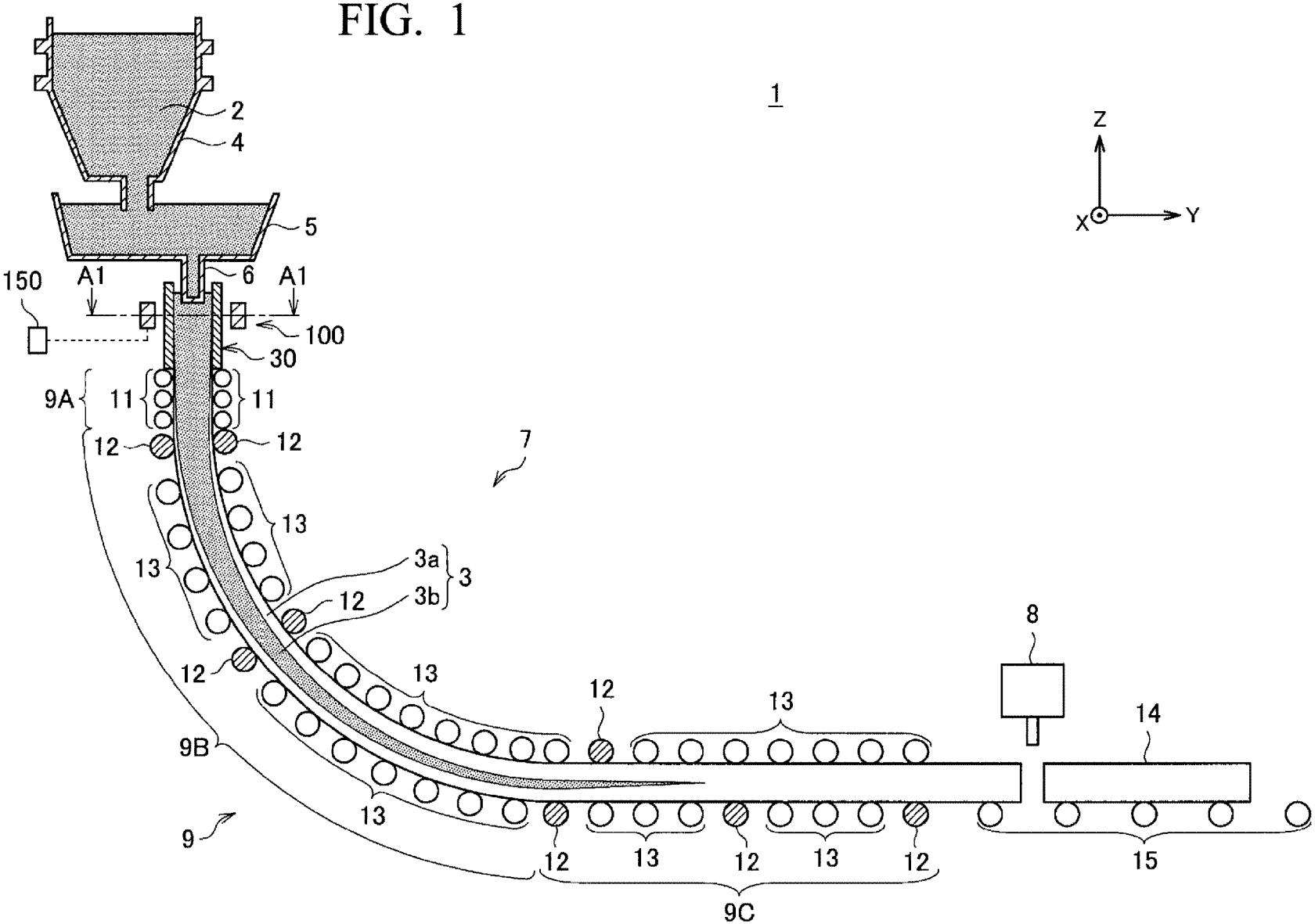
FIG. 1 is a side cross-sectional view schematically illustrating an example of a schematic configuration of a continuous casting machine including an electromagnetic stirring device according to this embodiment of the present invention.

Hereinafter, a preferred embodiment of the present invention is described in detail with reference to the accompanying drawings. Meanwhile, in this specification and the drawings, components having substantially the same functional configuration are assigned with the same reference sign, and the description thereof is not repeated. In addition, in this specification and the drawings, a plurality of components having substantially the same functional configuration is sometimes distinguished by different alphabets attached after the same reference sign. However, in a case where it is not necessary to especially distinguish each of the plurality of components having substantially the same functional configuration, only the same reference sign is assigned to each of the plurality of components.

Meanwhile, in the drawings referred to in this specification, sizes of some component members might be exaggerated for the sake of explanation. A relative size of each member illustrated in each drawing does not always accurately represent a magnitude relationship between actual members.

Although an example in which molten metal is molten steel is described below, the present invention is not limited to such an example and may also be applied to continuous casting for other metal.

<1. Schematic Configuration of Continuous Casting Machine>

First, a schematic configuration of a continuous casting machine 1 including an electromagnetic stirring device 100 according to the embodiment of the present invention is described with reference to FIG. 1.

FIG. 1 is a side cross-sectional view schematically illustrating an example of the schematic configuration of the continuous casting machine 1 including the electromagnetic stirring device 100 according to this embodiment.

The continuous casting machine 1 is a device for continuously casting molten steel using a mold for continuous casting to manufacture a bloom. The continuous casting machine 1 is provided with, for example, a mold 30, a ladle 4, a tundish 5, an immersion nozzle 6, a secondary cooling device 7, and a bloom cutter 8 as illustrated in FIG. 1.

The ladle 4 is a movable container for conveying molten steel 2 (molten metal) from outside to the tundish 5. The ladle 4 is arranged above the tundish 5, and the molten steel 2 in the ladle 4 is supplied to the tundish 5. The tundish 5 is arranged above the mold 30 to store the molten steel 2 and remove an inclusion in the molten steel 2. The immersion nozzle 6 extends downward from a lower end of the tundish 5 toward the mold 30 and a tip end thereof is immersed in the molten steel 2 in the mold 30. The immersion nozzle 6 continuously supplies the molten steel 2 from which the inclusion is removed in the tundish 5 into the mold 30.

The mold 30 has a quadrangular tubular shape corresponding to dimensions of a long side and a short side of a bloom 3, and is assembled, for example, so as to sandwich a pair of short side mold plates (corresponding to short side mold plates 32 and 34 illustrated in FIG. 2 and the like to be described later) by a pair of long side mold plates (corresponding to long side mold plates 31 and 33 illustrated in FIG. 2 and the like to be described later) from both sides. The long side mold plates and the short side mold plates (hereinafter, sometimes collectively referred to as mold plates) are, for example, water-cooled copper plates provided with a water channel through which cooling water flows. The mold 30 cools the molten steel 2 which comes into contact with the mold plates to manufacture the bloom 3. As the bloom 3 moves downward in the mold 30, solidification of an inner unsolidified portion 3*b* progresses, and a thickness of an outer solidified shell 3*a* gradually increases. The bloom 3 including the solidified shell 3*a* and the unsolidified portion 3*b* is pulled out of a lower end of the mold 30.

Meanwhile, in the following description, an up-and-down direction (that is, a direction in which the bloom 3 is pulled out of the mold 30) is also referred to as a Z-axis direction. The Z-axis direction is also referred to as a vertical direction. Two directions orthogonal to each other in a plane (horizontal plane) perpendicular to the Z-axis direction are also referred to as an X-axis direction and a Y-axis direction, respectively. The X-axis direction is defined as a direction parallel to the long side of the mold 30 in the horizontal plane (that is, a mold long side direction), and the Y-axis direction is defined as a direction parallel to the short side of the mold 30 in the horizontal plane (that is, a mold short side direction). A direction parallel to an X-Y plane is also referred to as a horizontal direction. In the following description, when expressing a size of each member, a length of the member in the Z-axis direction is sometimes also referred to as a height, and a length of the member in the X-axis direction or the Y-axis direction is sometimes also referred to as a width.

Herein, the electromagnetic stirring device 100 is installed at a side of the mold 30. The electromagnetic stirring device 100 applies an electromagnetic force which generates a swirling flow around a vertical axis to the molten steel 2 in the mold 30 by generating a rotating magnetic field in the mold 30. Specifically, the electromagnetic stirring device 100 includes a power supply device 150 and is driven by using electric power supplied from the power supply device 150. In this embodiment, by performing the continuous casting while driving the electromagnetic stirring device 100, the molten steel 2 in the mold 30 is stirred and a quality of the bloom may be improved. Such electromagnetic stirring device 100 is described later in detail.

The secondary cooling device 7 is provided in a secondary cooling zone 9 below the mold 30, and cools the bloom 3 pulled out of the lower end of the mold 30 while supporting and conveying the same. The secondary cooling device 7 includes a plurality of pairs of supporting rolls arranged on both sides in the short side direction of the bloom 3 (for example, support rolls 11, pinch rolls 12, and segment rolls 13), and a plurality of spray nozzles (not illustrated) which injects cooling water to the bloom 3.

The supporting rolls provided on the secondary cooling device 7 are arranged in pairs on both the sides in the short side direction of the bloom 3, and serve as a supporting/conveying means which conveys the bloom 3 while supporting the same. By supporting the bloom 3 from both the sides in the short side direction by the supporting rolls, breakout or bulging of the bloom 3 during solidification in the secondary cooling zone 9 may be prevented.

The support rolls 11, the pinch rolls 12, and the segment rolls 13 which are the supporting rolls form a conveyance path (path line) of the bloom 3 in the secondary cooling zone 9. As illustrated in FIG. 1, this path line is vertical immediately below the mold 30, then curved into a curve to be finally horizontal. In the secondary cooling zone 9, portions in which the path line is vertical, curved, and horizontal are referred to as a vertical portion 9A, a curved portion 9B, and a horizontal portion 9C, respectively. The continuous casting machine 1 including such path line is referred to as a vertical bending continuous casting machine 1. Meanwhile, the present invention is not limited to the vertical bending continuous casting machine 1 as illustrated in FIG. 1, but may also be applied to various other types of continuous casting machines such as a curved type or a vertical type.

The support rolls 11 are non-driven rolls provided in the vertical portion 9A immediately below the mold 30, and support the bloom 3 immediately after being pulled out of the mold 30. Immediately after being pulled out of the mold 30, the bloom 3 is in a state in which the solidified shell 3*a* is thin, so that this needs to be supported at a relatively short interval (roll pitch) in order to prevent breakout and bulging. Therefore, as the support roll 11, a roll having a small diameter capable of shortening the roll pitch is desirably used. In the example illustrated in FIG. 1, three pairs of support rolls 11 each having a small diameter are provided on both sides of the bloom 3 in the vertical portion 9A at a relatively narrow roll pitch.

The pinch rolls 12 are driven rolls rotated by a driving device such as a motor having a function of pulling the bloom 3 out of the mold 30. The pinch rolls 12 are arranged in appropriate positions in the vertical portion 9A, the curved portion 9B, and the horizontal portion 9C. The bloom 3 is pulled out of the mold 30 by a force transmitted from the pinch rolls 12 and is conveyed along the path line. Meanwhile, the arrangement of the pinch rolls 12 is not limited to the example illustrated in FIG. 1, and arranging positions thereof may be set arbitrarily.

The segment rolls 13 (also referred to as guide rolls) are non-driven rolls provided in the curved portion 9B and the horizontal portion 9C, and support and guide the bloom 3 along the path line. The segment rolls 13 may be arranged with different roll diameters and roll pitches depending on the position on the path line, and depending on a surface out of a fixed surface (F surface, a lower left surface in FIG. 1) or a loose surface (L surface, an upper right surface in FIG. 1) of the bloom 3 on which this is provided.

The bloom cutter 8 is arranged at a terminal end of the horizontal portion 9C of the path line and cuts the bloom 3 conveyed along the path line into a predetermined length. A cut bloom 14 is conveyed to equipment of a next step by table rolls 15.

The schematic configuration of the continuous casting machine 1 according to this embodiment is described above with reference to FIG. 1. Meanwhile, in this embodiment, it is sufficient that the electromagnetic stirring device 100 having a configuration to be described later is installed for the mold 30 and the continuous casting is performed using the electromagnetic stirring device 100; the configuration other than the electromagnetic stirring device 100 in the continuous casting machine 1 may be similar to that of a general conventional continuous casting machine. Therefore, the configuration of the continuous casting machine 1 is not limited to that illustrated in the drawing, and the continuous casting machine 1 having any configuration may be used.

<2. Configuration of Electromagnetic Stirring Device>

Subsequently, the configuration of the electromagnetic stirring device 100 according to this embodiment is described with reference to FIGS. 2 and 3.

Figure 2:
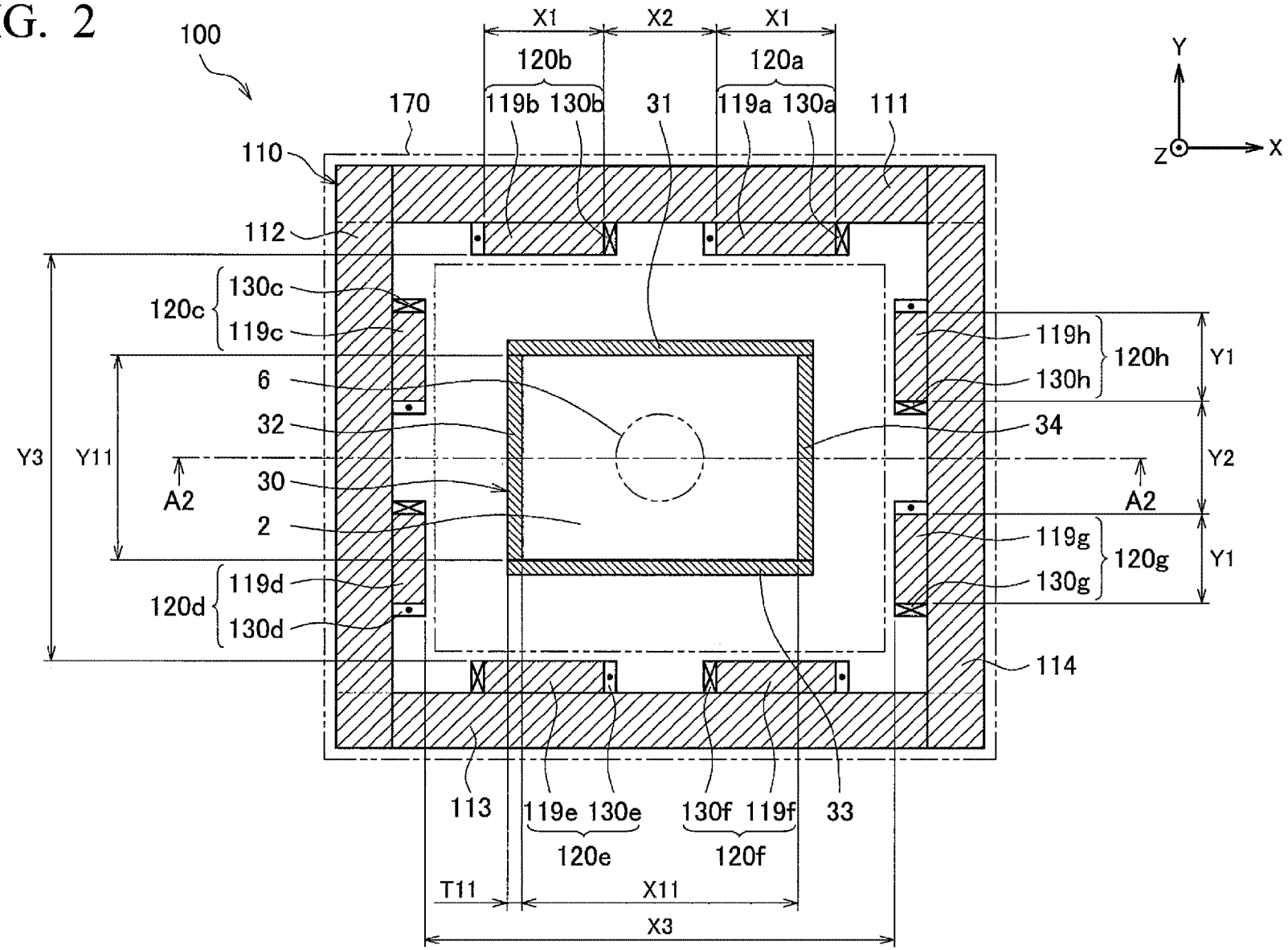
FIG. 2 is a top cross-sectional view illustrating an example of the electromagnetic stirring device according to this embodiment.
Figure 3:
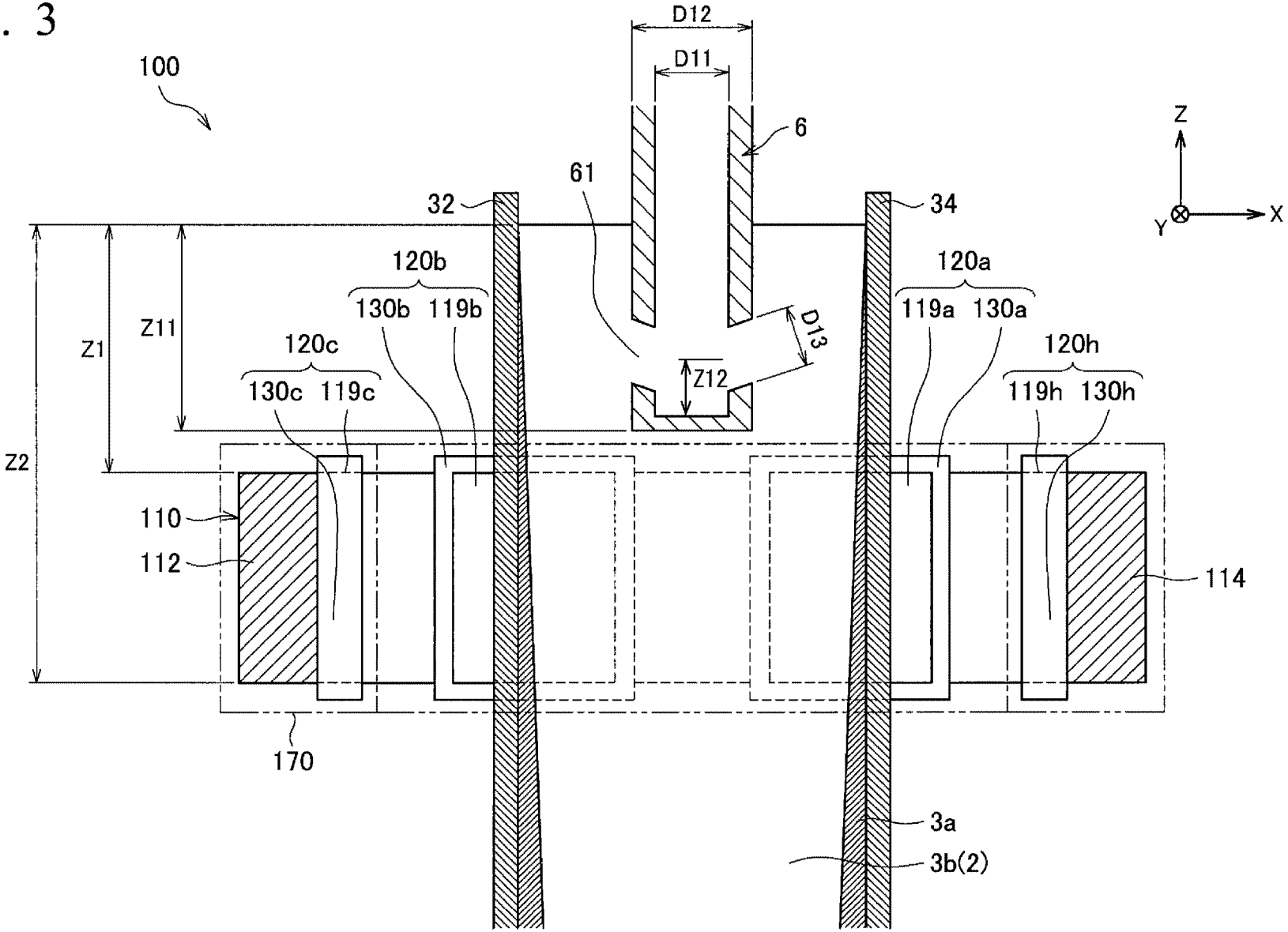
FIG. 3 is a side cross-sectional view illustrating an example of the electromagnetic stirring device according to this embodiment.

FIG. 2 is a top cross-sectional view illustrating an example of the electromagnetic stirring device 100 according to this embodiment. Specifically, FIG. 2 is a cross-sectional view taken along line A1-A1 in FIG. 1 passing through the mold 30 and parallel to the X-Y plane. FIG. 3 is a side cross-sectional view illustrating an example of the electromagnetic stirring device 100 according to this embodiment. Specifically, FIG. 3 is a cross-sectional view taken along line A2-A2 in FIG. 2 passing through the immersion nozzle 6 and parallel to the X-Z plane.

In this embodiment, the electromagnetic stirring device 100 is provided at the side of the mold 30 so as to enclose the mold 30.

As described above, the mold 30 has the quadrangular tubular shape and is assembled, for example, so as to sandwich the pair of short side mold plates 32 and 34 by the pair of long side mold plates 31 and 33 from both the sides. Specifically, the respective mold plates are annularly arranged in order of the long side mold plate 31, the short side mold plate 32, the long side mold plate 33, and the short side mold plate 34. Each mold plate may be, for example, the water-cooled copper plate as described above, but is not limited to such an example; this may also be formed of various materials generally used as a mold of a continuous casting machine.

Herein, this embodiment is targeted to bloom continuous casting, and a bloom size is about 300 to 500 mm on one side (that is, the length in the X-axis direction and the Y-axis direction). For example, a width X11 in the long side direction of the bloom 3 is 456 mm, and a width Y11 in the short side direction of the bloom 3 is 339 mm.

Each mold plate has a size corresponding to the bloom size. For example, the long side mold plates 31 and 33 have a width in the long side direction at least longer than the width X11 in the long side direction of the bloom 3, and the short side mold plates 32 and 34 have a width in the short side direction substantially the same as the width Y11 in the short side direction of the bloom 3. A thickness T11 of each mold plate is, for example, 25 mm.

In order to more effectively obtain an effect of improving a quality of the bloom 3 by the electromagnetic stirring device 100, the mold 30 is desirably formed to have the length in the Z-axis direction as long as possible. It is generally known that there is a case where, when solidification of the molten steel 2 progresses in the mold 30, the bloom 3 is separated from an inner wall of the mold 30 due to solidification contraction, so that the bloom 3 is not cooled sufficiently. Therefore, the length of the mold 30 is limited to about 1,000 mm at the longest from a molten steel bath level. In this embodiment, in consideration of such circumstances, each mold plate is formed so that the length from the molten steel bath level to a lower end of each mold plate is about 1,000 mm, for example.

The electromagnetic stirring device 100 is provided with, for example, an iron core 110, a plurality of coils 130 (130*a*, 130*b*, 130*c*, 130*d*, 130*e*, 130*f*, 130*g*, and 130*h*), the power supply device 150 described above, and a case 170 as illustrated in FIGS. 2 and 3. Meanwhile, in FIGS. 2 and 3, the power supply device 150 is not illustrated for easier understanding, and the iron core 110 and the plurality of coils 130 accommodated in the case 170 are transparently illustrated in the case 170.

The iron core 110 is a solid member including a pair of long side main bodies 111 and 113, a pair of short side main bodies 112 and 114 (hereinafter sometimes collectively referred to as main bodies), and a plurality of teeth 119 (119*a*, 119*b*, 119*c*, 119*d*, 119*e*, 119*f*, 119*g*, and 119*h*). The iron core 110 is formed, for example, by stacking electrical steel sheets. The coil 130 is wound around each teeth 119 of the iron core 110, and a magnetic field is generated by application of an alternating current to each coil 130. In this manner, the teeth 119 and the coils 130 wound around the teeth 119 form magnetic pole portions 120 (120*a*, 120*b*, 120*c*, 120*d*, 120*e*, 120*f*, 120*g*, and 120*h*) which serve as magnetic poles when the alternating current is applied.

The long side main bodies 111 and 113 are provided on an outer side of the mold 30 so as to face the long side mold plates 31 and 33, respectively. The short side main bodies 112 and 114 are provided on an outer side of the mold 30 so as to face the short side mold plates 32 and 34, respectively. The long side main body and the short side main body adjacent to each other are connected by, for example, being fastened in a state in which ends thereof are overlapped with each other. As a result, the pair of long side main bodies 111 and 113 and the pair of short side main bodies 112 and 114 form a closed loop enclosing the mold 30 at the side of the mold 30. Specifically, the respective main bodies are annularly arranged in a circumferential direction of the mold 30 in order of the long side main body 111, the short side main body 112, the long side main body 113, and the short side main body 114.

Two teeth 119 are arranged side by side in the circumferential direction of the mold 30 in a portion on a side of the mold 30 of each main body. For example, the teeth 119*a* and 119*b* are provided in the circumferential direction of the mold 30 in a portion facing the long side mold plate 31 of the long side main body 111. The teeth 119*c* and 119*d* are provided in the circumferential direction of the mold 30 in a portion facing the short side mold plate 32 of the short side main body 112. The teeth 119*e* and 119*f* are provided in the circumferential direction of the mold 30 in a portion facing the long side mold plate 33 of the long side main body 113. The teeth 119*g* and 119*h* are provided in the circumferential direction of the mold 30 in a portion facing the short side mold plate 34 of the short side main body 114. Specifically, the teeth 119 are annularly arranged in the circumferential direction of the mold 30 in order of the teeth 119*a*, 119*b*, 119*c*, 119*d*, 119*e*, 119*f*, 119*g*, and 119*h*.

In this manner, the iron core 110 includes, for each of outer side surfaces of the mold 30, the two teeth 119 arranged side by side in the circumferential direction of the mold 30 so as to face the outer side surface. Therefore, in the electromagnetic stirring device 100 according to this embodiment, two magnetic pole portions 120 each of which is formed of the teeth 119 of the iron core 110 and the coil 130 wound around the teeth 119 are arranged in the circumferential direction of the mold 30 for each of the outer side surfaces of the mold 30. The present inventor found that it is possible to appropriately generate the swirling flow around the vertical axis while suppressing a flow in the vertical direction in the molten steel 2 in the mold 30 by arranging the magnetic pole portions 120 for the mold 30 in this manner. The flow generated in the molten steel 2 in the mold 30 by the electromagnetic stirring device 100 according to this embodiment is described later in detail.

The teeth 119 project into rectangular parallelepiped shapes in the horizontal direction from the main body toward the mold 30 and are provided at intervals in the circumferential direction of the mold 30. A height of the teeth 119 in the Z-axis direction is, for example, comparable with that of the main body. As described above, since the teeth 119 and the coil 130 wound around the teeth 119 serve as the magnetic pole when the alternating current is applied, a size of each teeth 119 and a positional relationship between the teeth 119 affect the magnetic field generated by the electromagnetic stirring device 100. Therefore, the size of each teeth 119 and the positional relationship between the teeth 119 may be appropriately determined so that a desired electromagnetic force may be applied to the molten steel 2 by the electromagnetic stirring device 100.

A width X1 in the long side direction of the teeth 119*a*, 119*b*, 119*e*, and 119*f* provided on the long side main bodies (hereinafter also referred to as long side teeth) is, for example, 240 mm. A width Y1 in the short side direction of the teeth 119*c*, 119*d*, 119*g*, and 119*h* provided on the short side main bodies (hereinafter also referred to as short side teeth) is, for example, 190 mm. Meanwhile, the width X1 in the long side direction of the long side teeth and the width Y1 in the short side direction of the short side teeth do not necessarily have to match, but they are desirably comparable with each order in order to more stably generate the swirling flow around the vertical axis in the molten steel 2 in the mold 30.

An interval X2 between the long side teeth (for example, between the teeth 119*a* and 119*b*) is, for example, 140 mm. An interval Y2 between the short side teeth (for example, between the teeth 119*g* and 119*h*) is, for example, 140 mm.

An interval X3 between the magnetic pole portions 120 facing each other in the mold long side direction (for example, between the magnetic pole portions 120*d* and 120*g*) is, for example, 775 mm. An interval Y3 between the magnetic pole portions 120 facing each other in the mold short side direction (for example, between the magnetic pole portions 120*b* and 120*e*) is, for example, 670 mm.

Positions in the vertical direction and sizes of the teeth 119 (that is, a position in the vertical direction and a size of the iron core 110) are appropriately set according to a position and a size of the immersion nozzle 6 and a position of the bath level of the molten steel 2.

A distance Z1 in the vertical direction between an upper surface of the teeth 119 and the bath level of the molten steel 2 is, for example, 280 mm. A distance Z2 in the vertical direction between a lower surface of the teeth 119 and the bath level of the molten steel 2 is, for example, 580 mm.

Meanwhile, a distance Z11 in the vertical direction between a bottom surface of the immersion nozzle 6 and the bath level of the molten steel 2 is 250 mm, for example. An inner diameter D11 of the immersion nozzle 6 is 90 mm, for example. An outer diameter D12 of the immersion nozzle 6 is 145 mm, for example. A height Z12 from a bottom of a discharge hole 61 of the immersion nozzle 6 is, for example, 85 mm. A width D13 of the discharge hole 61 of the immersion nozzle 6 is, for example, 80 mm. The discharge hole 61 of the immersion nozzle 6 is inclined by 15° upward from an inner side toward an outer side of the nozzle, for example. A pair of such discharge holes 61 is provided in positions facing the short side mold plates 32 and 34 on the immersion nozzle 6.

The coil 130 is wound around each teeth 119 with a protruding direction of each teeth 119 as a winding axis direction (that is, the coil 130 is wound to magnetize each teeth 119 in the protruding direction of each teeth 119). For example, the coils 130*a*, 130*b*, 130*c*, 130*d*, 130*e*, 130*f*, 130*g* and 130*h* are wound around the teeth 119*a*, 119*b*, 119*c*, 119*d*, 119*e*, 119*f*, 119*g*, and 119*h*, respectively. As a result, the magnetic pole portions 120*a*, 120*b*, 120*c*, 120*d*, 120*e*, 120*f*, 120*g*, and 120*h* are formed. The coil 130 is wound around the long side teeth with the Y-axis direction as the winding axis direction, and the coil 130 is wound around the short side teeth with the X-axis direction as the winding axis direction.

As a conductive wire forming the coil 130, for example, a copper wire having a cross-section of 10 mm×10 mm and including a cooling water channel having a diameter of about 5 mm inside is used. When a current is applied, the conductive wire is cooled using the cooling water channel. The conductive wire a surface layer of which is insulated with insulating paper or the like may be wound in layers. For example, each coil 130 is formed by winding the conductive wire in about two to four layers.

The power supply device 150 illustrated in FIG. 1 is connected to each of the plurality of such coils 130. The power supply device 150 applies an alternating current to each coil 130 with a phase shift by 90° in arrangement order of the coils 130 so as to generate the rotating magnetic field in the mold 30. As a result, the electromagnetic force which generates the swirling flow around the vertical axis may be applied to the molten steel 2 in the mold 30. Specifically, the power supply device 150 preferably applies the alternating current of 1.0 Hz to 6.0 Hz to each coil 130, and more preferably applies the alternating current of 1.0 Hz to 4.0 Hz.

Drive of the power supply device 150 may be appropriately controlled by a control device (not illustrated) including a processor and the like operating according to a predetermined program. Specifically, by controlling a current value (effective value) applied to each coil 130 and a frequency by the control device, strength of the electromagnetic force applied to the molten steel 2 may be controlled. Meanwhile, a method of applying the alternating current to each coil 130 is described later in detail.

The case 170 is an annular hollow member which covers the iron core 110 and the coil 130. A size of the case 170 may be appropriately determined so that a desired electromagnetic force may be applied to the molten steel 2 by the electromagnetic stirring device 100. Since a magnetic flux enters the mold 30 from the coil 130 through a side wall of the case 170 in the magnetic field generated by the electromagnetic stirring device 100, a non-magnetic member of which strength may be secured such as non-magnetic stainless steel or fiber reinforced plastics (FRP), for example, is used as a material of the case 170.

<3. Operation of Electromagnetic Stirring Device>

Subsequently, an operation of the electromagnetic stirring device 100 according to this embodiment is described with reference to FIGS. 4 and 5.

Figure 4:
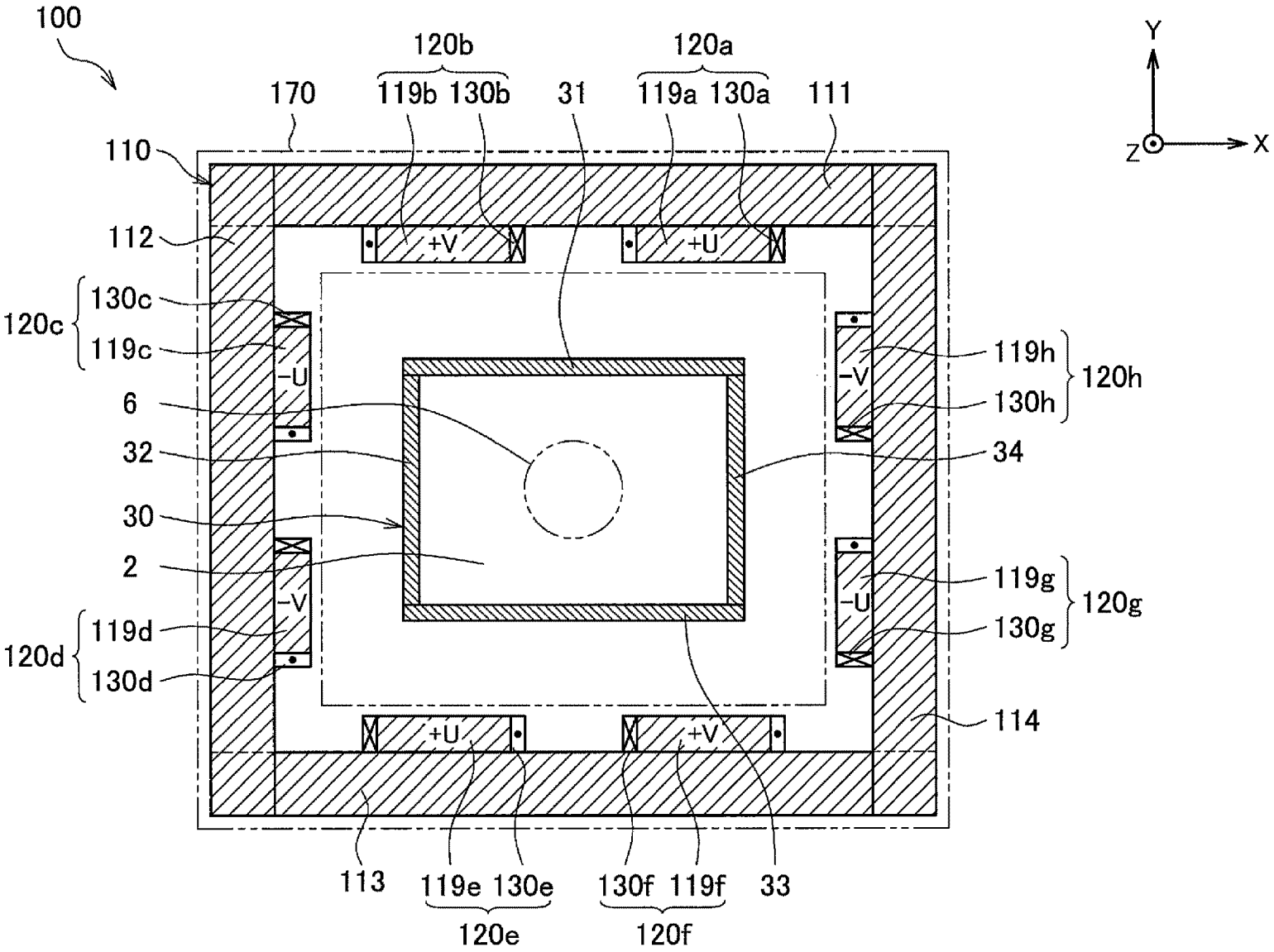
FIG. 4 is a top cross-sectional view illustrating an example of a state in which an alternating current is applied to each coil of the electromagnetic stirring device.
Figure 5:
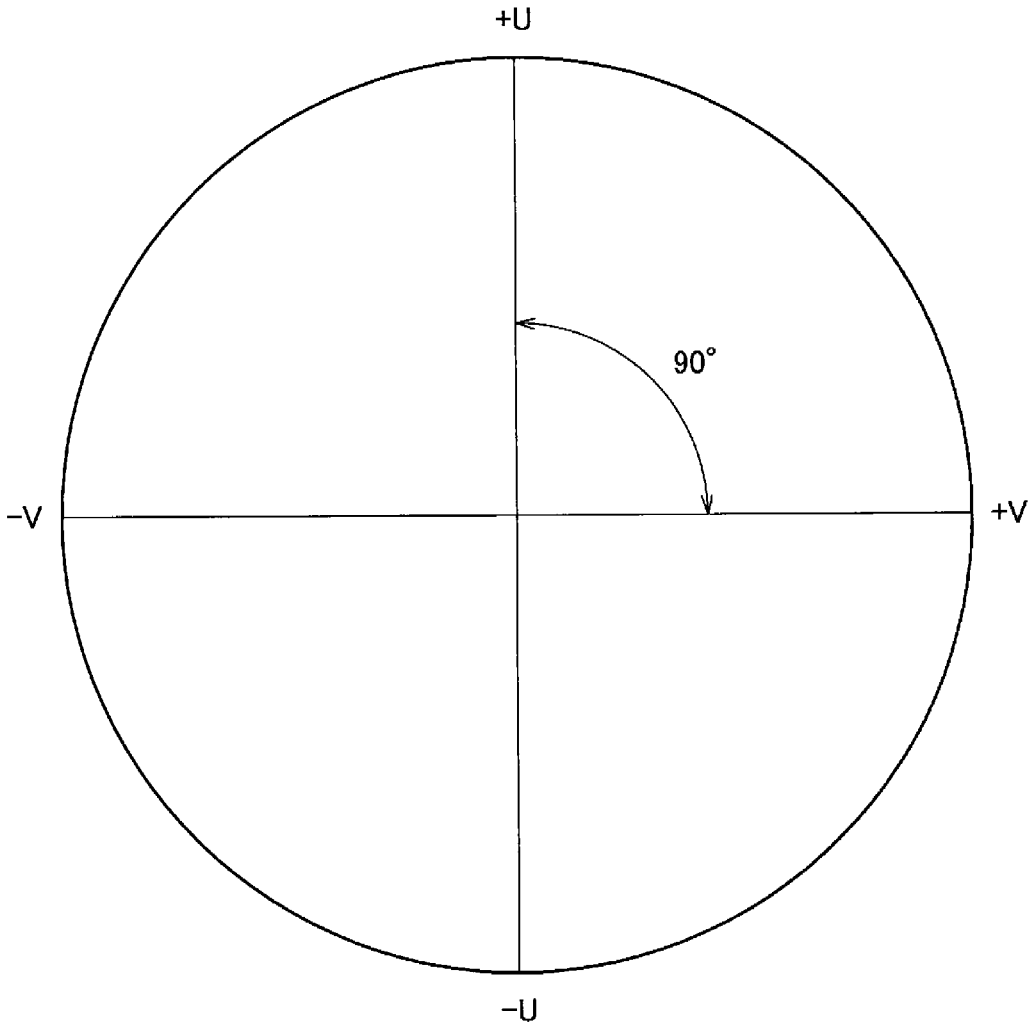
FIG. 5 is a view for illustrating a phase of the alternating current applied to each coil of the electromagnetic stirring device.

FIG. 4 is a top cross-sectional view illustrating an example of a state in which the alternating current is applied to each coil 130 of the electromagnetic stirring device 100. Specifically, FIG. 4 is a cross-sectional view taken along line A1-A1 in FIG. 1 passing through the mold 30 and parallel to the X-Y plane. FIG. 5 is a view for illustrating the phase of the alternating current applied to each coil 130 of the electromagnetic stirring device 100.

In the electromagnetic stirring device 100, as described above, the power supply device 150 applies the alternating current to each coil 130 such that the phase shifts by 90° in the arrangement order of the coils 130. For example, as illustrated in FIG. 4, the power supply device 150 applies two-phase alternating currents (+U and +V) with phase shift by 90° to the coils 130. Considering a direction of the current also, the power supply device 150 may apply four types of alternating currents of +U, +V, −U, and −V with phase shift by 90° to the coils 130. FIG. 5 schematically illustrates the phases of the four types of alternating currents. In FIG. 5, positions on a circumference represent the phases among the alternating currents; for example, +V is with a phase delay by 90° from +U.

When the alternating current of +U is applied to a certain coil 130, the alternating current of +V is applied to the coil 130 adjacent thereto, the alternating current of −U is applied to the coil 130 adjacent thereto, and the alternating current of −V is applied to the coil 130 adjacent thereto. Similarly, the alternating currents of +U, +V, −U, and −V are sequentially applied to the coils 130 arranged next to the coil 130 adjacent thereto. For example, to the coils 130*a*, 130*b*, 130*c*, 130*d*, 130*e*, 130*f*, 130*g*, and 130*h*, the alternating currents of +U, +V, −U, −V, +U, +V, −U, and −V are applied, respectively.

By applying the alternating currents to the respective coils 130 with such a phase difference, the rotating magnetic field which rotates in the circumferential direction of the mold 30 is generated in the mold 30. As a result, the electromagnetic force in the circumferential direction of the mold 30 is applied to the molten steel 2 in the mold 30, so that the swirling flow around the vertical axis is generated in the molten steel 2.

By generating the rotating magnetic field by the electromagnetic stirring device 100 using the two-phase alternating currents, it is possible to generate the swirling flow around the vertical axis in the molten steel 2 at a lower cost as compared with a case of using a three-phase alternating power supply. In a case of using the two-phase alternating currents, it is necessary to apply the alternating current to each coil 130 with a phase shift by 90° in the arrangement order of the coils 130, so that the number of coils 130 is desirably a multiple of 4.

EXAMPLE 1

A result of an electromagnetic field analysis simulation performed for confirming the flow generated in the molten steel 2 in the mold 30 in this embodiment is described.

(Simulation 1)

Various simulation conditions were set as described below, and the electromagnetic field analysis simulation was performed regarding each of the electromagnetic stirring device 100 according to this embodiment and an electromagnetic stirring device 900 according to a comparative example.

Figure 6:
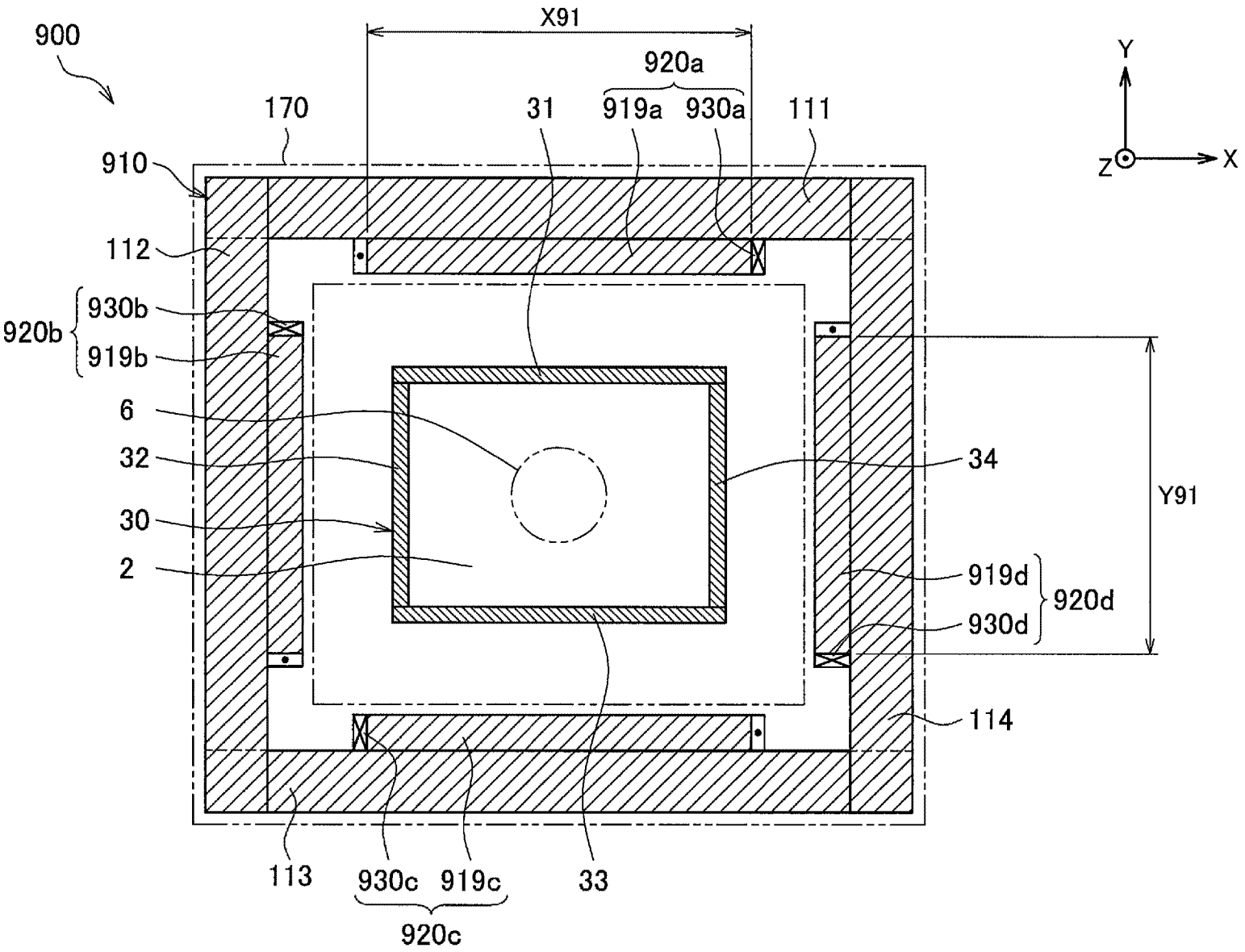
FIG. 6 is a top cross-sectional view illustrating an electromagnetic stirring device according to a comparative example.

Herein, the electromagnetic stirring device 900 according to the comparative example is described with reference to FIG. 6. FIG. 6 is a top cross-sectional view illustrating the electromagnetic stirring device 900 according to the comparative example. Specifically, FIG. 6 is a cross-sectional view taken along line A1-A1 in FIG. 1 in a case where the electromagnetic stirring device 900 is applied in place of the electromagnetic stirring device 100 to the continuous casting machine 1.

The electromagnetic stirring device 900 according to the comparative example is different from the electromagnetic stirring device 100 described above in that only one teeth 919 (919*a*, 919*b*, 919*c*, and 919*d*) is provided for one side in a portion on a side of a mold 30 in each main body in an iron core 910. Therefore, in the electromagnetic stirring device 900 according to the comparative example, one magnetic pole portion 920 (920*a*, 920*b*, 920*c*, and 920*d*) formed of the teeth 919 of the iron core 910 and a coil 930 (930*a*, 930*b*, 930*c*, and 930*d*) wound around the teeth 919 is arranged for each outer side surface of the mold 30.

Specifically, the teeth 919*a*, 919*b*, 919*c*, and 919*d* are provided in portions facing corresponding mold plates of a long side main body 111, a short side main body 112, a long side main body 113, and a short side main body 114, respectively. The coils 930*a*, 930*b*, 930*c*, and 930*d* are wound around the teeth 919*a*, 919*b*, 919*c*, and 919*d*, respectively. As a result, the magnetic pole portions 920*a*, 920*b*, 920*c*, and 920*d* are formed. A width X91 in a long side direction of the long side teeth 919*a* and 919*c* is 625 mm. A width Y91 in a short side direction of the short side teeth 919*b* and 919*d* is 520 mm.

Meanwhile, as in the electromagnetic stirring device 100 described above, in the electromagnetic stirring device 900 according to the comparative example, an alternating current is applied to each coil 930 with a phase shift by 90° in arrangement order of the coils 930 so as to generate a rotating magnetic field in the mold 30. As a result, the electromagnetic force which generates the swirling flow around the vertical axis may be applied to the molten steel 2 in the mold 30.

The conditions of the electromagnetic field analysis simulation regarding this embodiment are as follows. Meanwhile, the electromagnetic field analysis simulation was performed assuming that a material of the iron core 110 is a silicon steel sheet and that no eddy current is generated in the iron core 110.

Width X11 in long side direction of bloom: 456 mm

Width Y11 in short side direction of bloom: 339 mm

Thickness T11 of mold plate: 25 mm

Width X1 in long side direction of long side teeth: 240 mm

Width Y1 in short side direction of short side teeth: 190 mm

Interval X2 between long side teeth: 140 mm

Interval Y2 between short side teeth: 140 mm

Interval X3 between magnetic pole portions facing each other in mold long side direction: 775 mm Interval Y3 between magnetic pole portions facing each other in mold short side direction: 670 mm Distance Z1 in vertical direction between upper surface of teeth and bath level of molten steel: 280 mm.

Distance Z2 in vertical direction between lower surface of teeth and bath level of molten steel: 580 mm.

Conductivity of mold plate: $7.14\times10^5$ S/m

Conductivity of molten steel: $2.27\times10^5$ S/m

Winding in coil: 36 turns

Current value (effective value) of alternating current applied to coil: 640 A

Current frequency of alternating current applied to coil: 1.8 Hz

The conditions of the electromagnetic field analysis simulation regarding the comparative example were obtained by deleting the conditions X1, Y1, X2, and Y2 from the conditions regarding this embodiment and adding following conditions X91 and Y91.

Width X91 in long side direction of long side teeth: 625 mm

Width Y91 in short side direction of short side teeth: 520 mm

Figure 7:
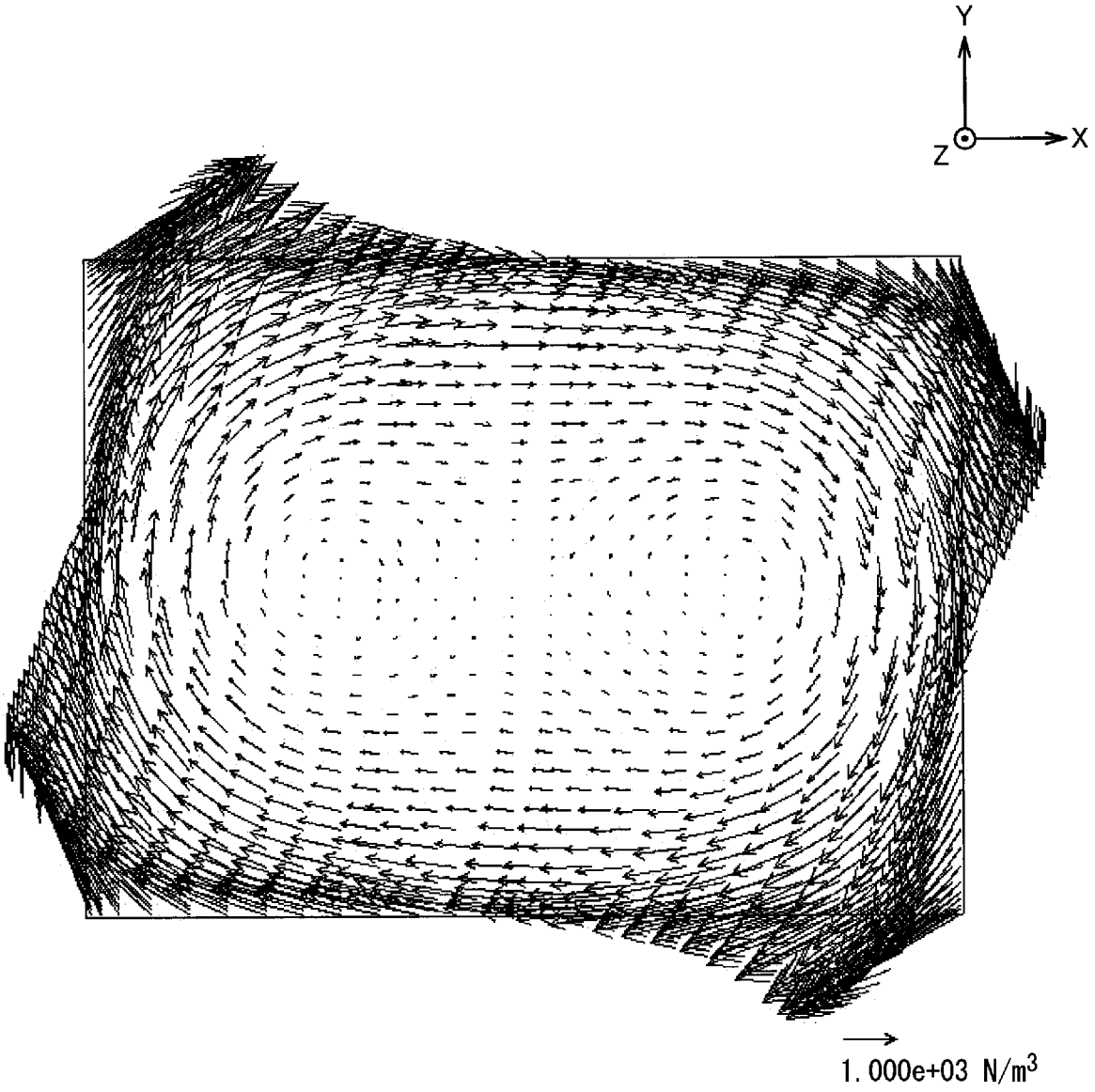
FIG. 7 is a view illustrating an example of distribution of an electromagnetic force applied to molten steel in a mold in a horizontal plane in a center position in a vertical direction of an iron core obtained by an electromagnetic field analysis simulation regarding this embodiment.
Figure 8:
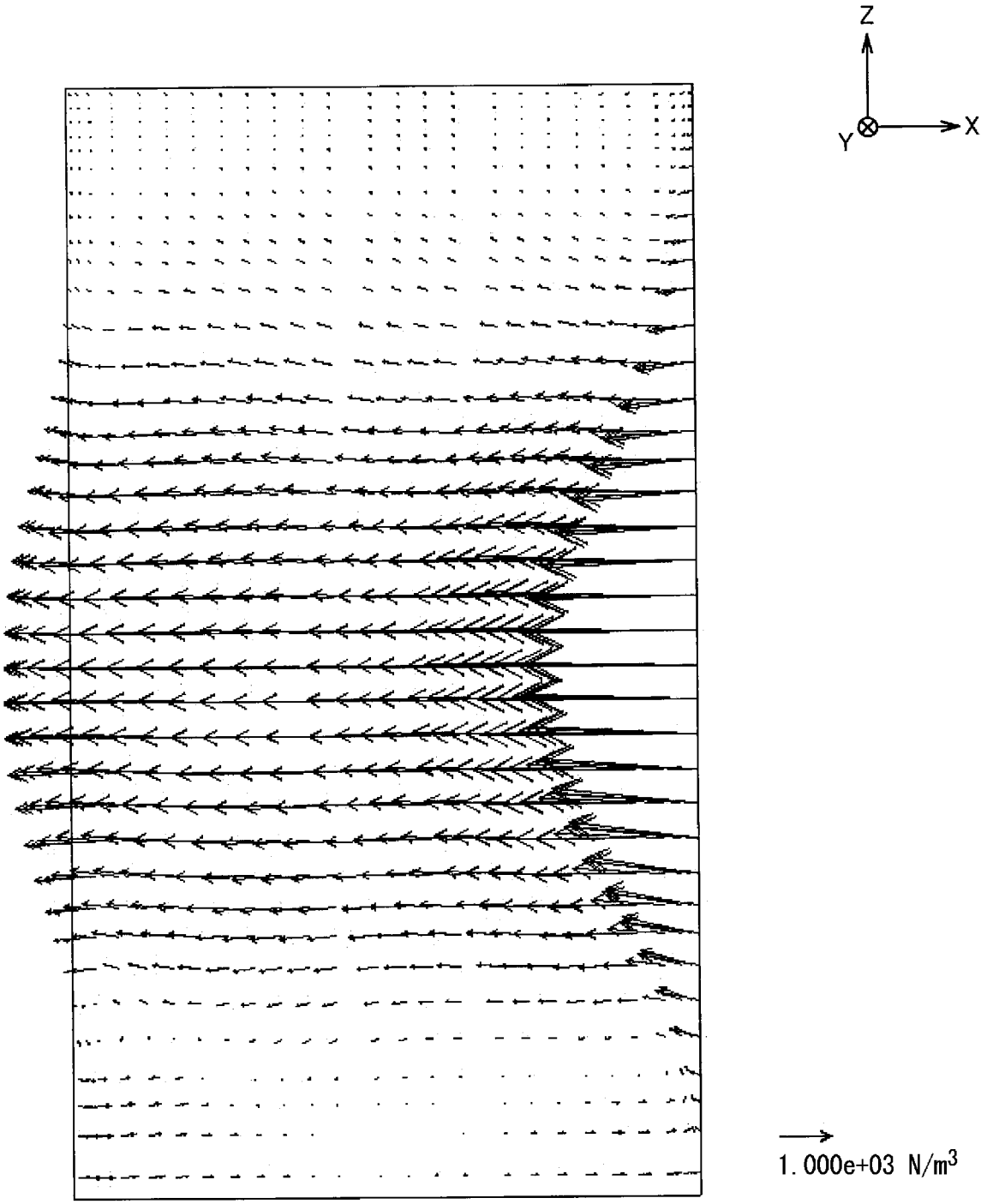
FIG. 8 is a view illustrating an example of distribution of the electromagnetic force applied to the molten steel in the mold in the vicinity of an inner side surface of a long side mold plate obtained by the electromagnetic field analysis simulation regarding this embodiment.
Figure 9:
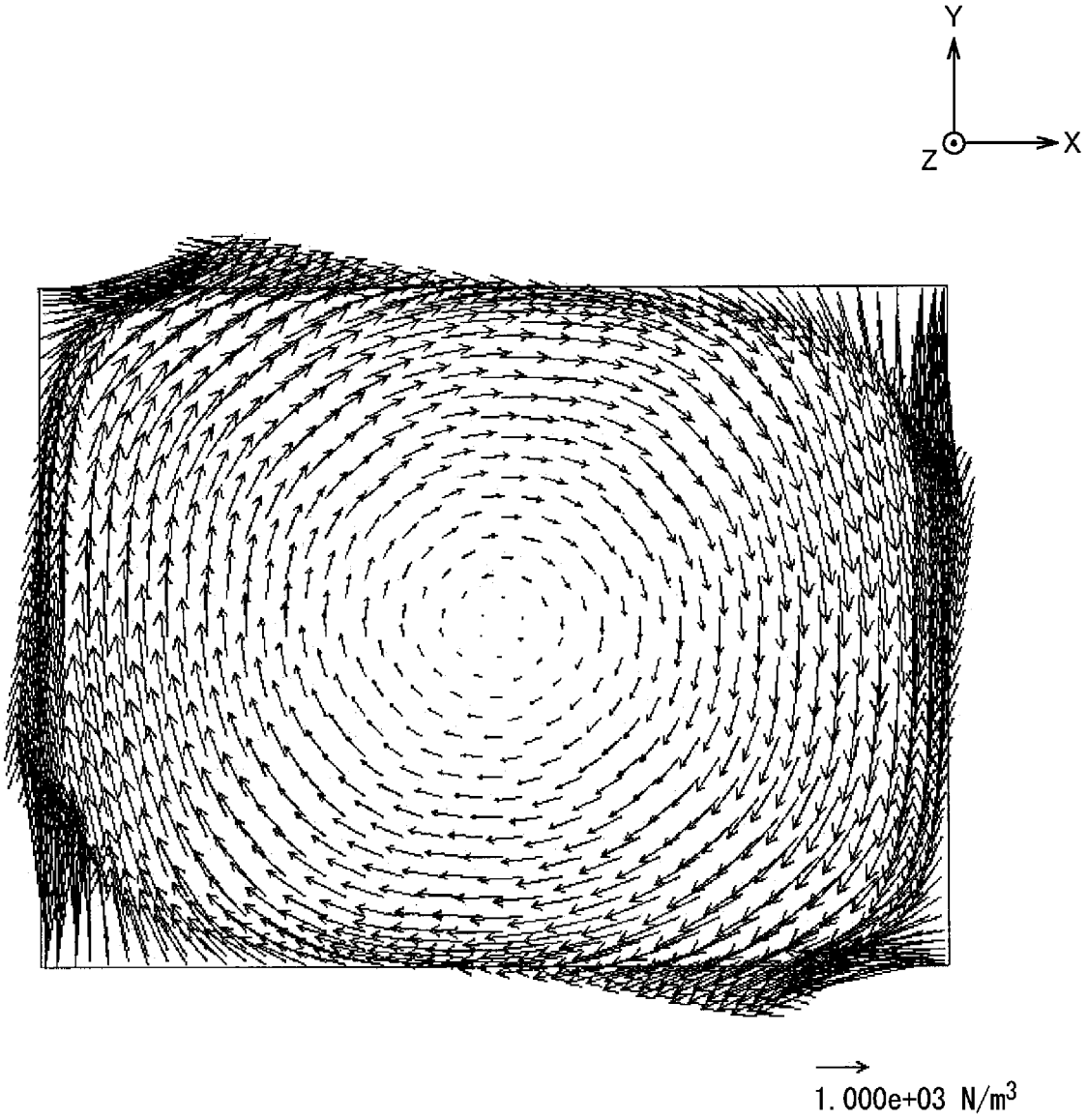
FIG. 9 is a view illustrating an example of distribution of an electromagnetic force applied to the molten steel in the mold in a horizontal plane in a center position in a vertical direction of an iron core obtained by an electromagnetic field analysis simulation regarding the comparative example.
Figure 10:
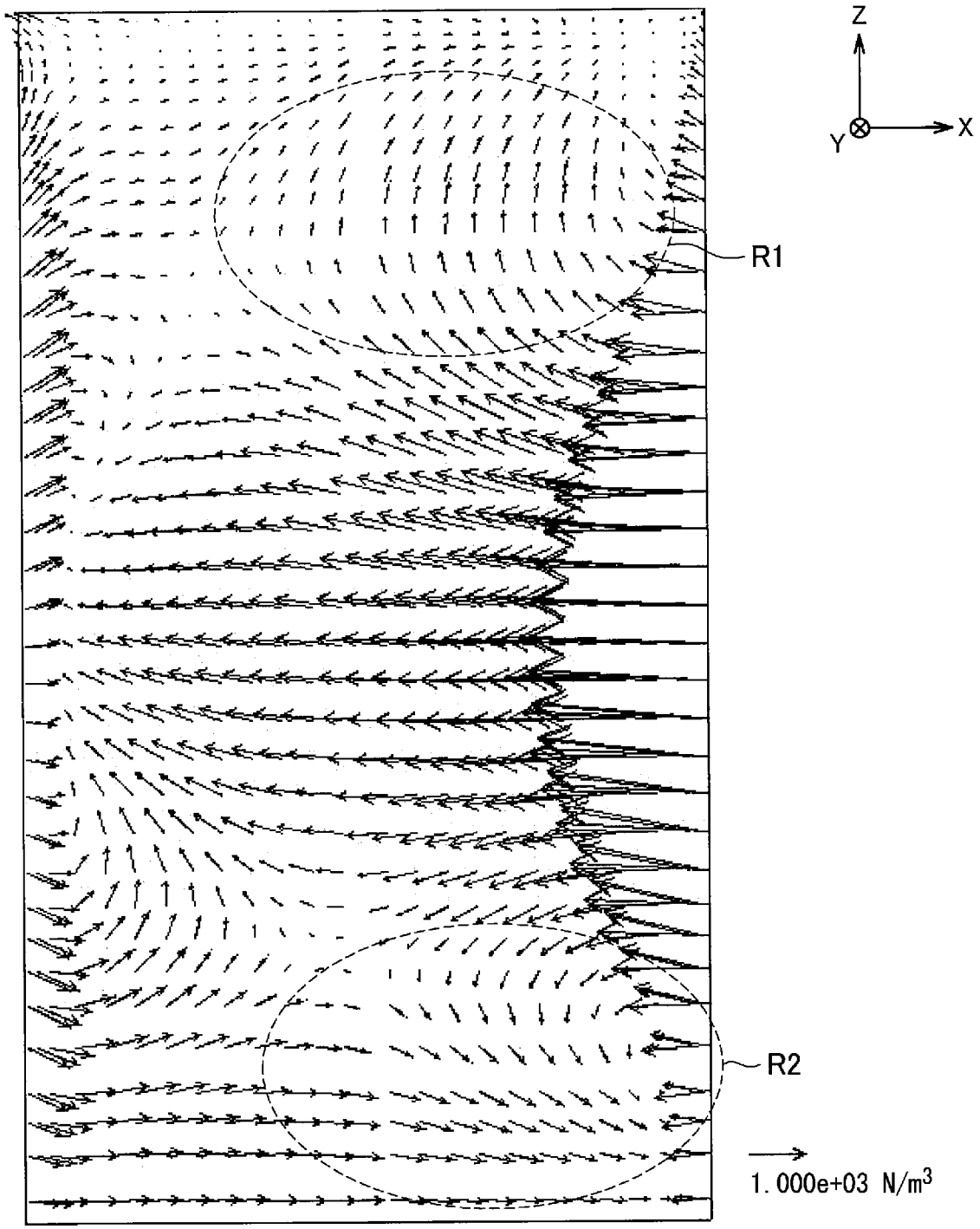
FIG. 10 is a view illustrating an example of distribution of the electromagnetic force applied to the molten steel in the mold in the vicinity of an inner side surface of a long side mold plate obtained by the electromagnetic field analysis simulation regarding the comparative example.

Results of the above-described electromagnetic field analysis simulation are illustrated in FIGS. 7 to 10. FIG. 7 is a view illustrating an example of distribution of the electromagnetic force applied to the molten steel 2 in the mold 30 in a horizontal plane in a center position in the vertical direction of the iron core 110 obtained by the electromagnetic field analysis simulation regarding this embodiment. FIG. 8 is a view illustrating an example of distribution of the electromagnetic force applied to the molten steel 2 in the mold 30 in the vicinity of an inner side surface of the long side mold plate 33 obtained by the electromagnetic field analysis simulation regarding this embodiment. FIG. 9 is a view illustrating an example of distribution of the electromagnetic force applied to the molten steel 2 in the mold 30 in a horizontal plane in a center position in the vertical direction of the iron core 910 obtained by the electromagnetic field analysis simulation regarding the comparative example. FIG. 10 is a view illustrating an example of distribution of the electromagnetic force applied to the molten steel 2 in the mold 30 in the vicinity of an inner side surface of the long side mold plate 33 obtained by the electromagnetic field analysis simulation regarding the comparative example. In FIGS. 7 to 10, a Lorentz force density vector representing the electromagnetic force ($N/m^3$) acting per unit volume of the molten steel 2 as a vector amount is indicated by an arrow.

Regarding the comparative example, with reference to FIG. 9, it is confirmed that the electromagnetic force is distributed so as to generate the swirling flow around the vertical axis in the molten steel 2 in the mold 30. However, with reference to FIG. 10, in the comparative example, the electromagnetic force having a relatively large vertical component is confirmed. For example, in an upper region R1 in the mold 30, as illustrated in FIG. 10, a relatively large upward electromagnetic force is confirmed. In a lower region R2 in the mold 30, as illustrated in FIG. 10, a relatively large downward electromagnetic force is confirmed. Specifically, according to the result of the electromagnetic field analysis simulation regarding the comparative example, in a case where a positive direction and a negative direction are defined as an upward direction and a downward direction, respectively, a maximum value, a minimum value, and an average value of the vertical components of the electromagnetic force applied to the molten steel 2 in the mold 30 were 479 $N/m^3$, −378 $N/m^3$, and 57 $N/m^3$, respectively.

Figure 11:
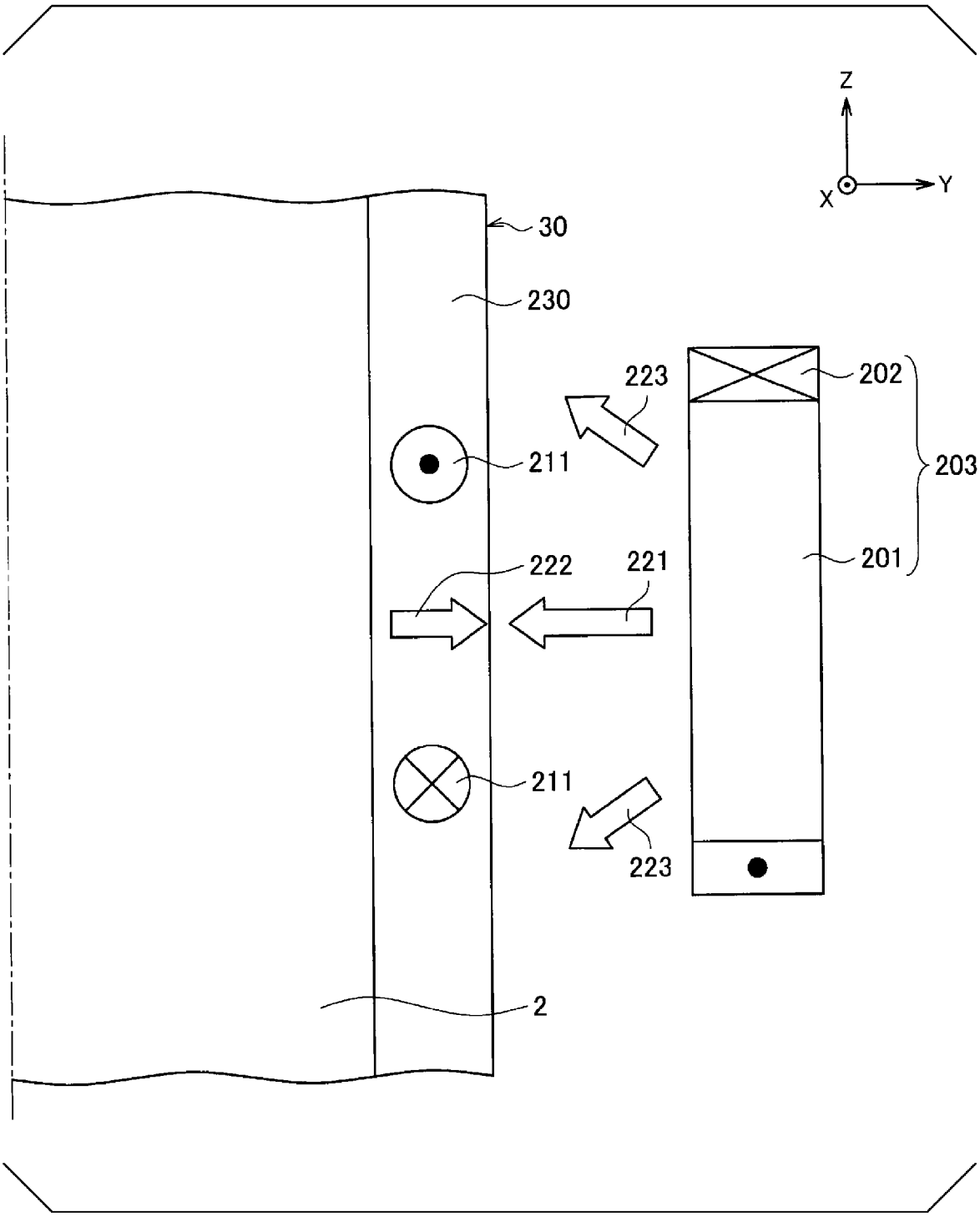
FIG. 11 is a view for explaining a leakage flux in a magnetic field generated by a coil.

Herein, a leakage flux in the magnetic field generated by the coil is described with reference to FIG. 11. FIG. 11 schematically illustrates a magnetic pole portion 203 located at the side of the mold 30. The magnetic pole portion 203 is formed of the teeth 201 of an iron core and a coil 202 wound around the teeth 201.

When an alternating current is applied to the coil 202, first, a magnetic flux 221 enters a mold plate 230 from the magnetic pole portion 203 in the horizontal direction. As a result, an eddy current 211 is generated in the mold plate 230 due to a change in time of the magnetic flux which horizontally passes through the mold plate 230. Herein, the eddy current 211 generated in the mold plate 230 flows in a direction to generate a magnetic field to weaken the magnetic flux 221 horizontally entering the mold plate 230 from the magnetic pole portion 203. Therefore, a magnetic flux 222 horizontally entering the magnetic pole portion 203 from the mold plate 230 acts on the magnetic flux 221 to weaken the magnetic flux 221 horizontally entering the mold plate 230 from the magnetic pole portion 203. As a result, in the magnetic field generated by the magnetic pole portion 203, the magnetic flux horizontally entering the mold plate 230 from the magnetic pole portion 203 is weakened, and a leakage flux 223 including a vertical component is generated.

In the comparative example, it is considered that the electromagnetic force having the relatively large vertical component is applied to the molten steel 2 in the mold 30 due to the generation of a relatively large number of such leakage fluxes.

Regarding this embodiment, with reference to FIG. 7, it is confirmed that the electromagnetic force is distributed so as to generate the swirling flow around the vertical axis in the molten steel 2 in the mold 30 as in the comparative example. Herein, with reference to FIG. 8, it is confirmed that each Lorentz force density vector basically mainly has a horizontal component. In this manner, in this embodiment, it is confirmed that the vertical components of the electromagnetic force applied to the molten steel 2 in the mold 30 decrease from those in the comparative example. Specifically, according to the result of the electromagnetic field analysis simulation regarding this embodiment, a maximum value, a minimum value, and an average value of the vertical components of the electromagnetic force applied to the molten steel 2 in the mold 30 were 323 $N/m^3$, −212 $N/m^3$, and 7.5 $N/m^3$, respectively. From this also, it is understood that the vertical components of the electromagnetic force applied to the molten steel 2 in the mold 30 decrease in this embodiment from those in the comparative example.

In the magnetic field generated by the magnetic pole portion of the electromagnetic stirring device, the leakage flux is generated due to the eddy current generated in the mold plate as described above. Herein, the stronger the magnetic flux horizontally entering the mold plate from the magnetic pole portion, the larger the eddy current generated in the mold plate. As a result, an effect of weakening the magnetic flux horizontally entering the mold plate from the magnetic pole portion by the eddy current increases. Therefore, the stronger the magnetic flux horizontally entering the mold plate from the magnetic pole portion, the more the leakage fluxes are generated.

In the electromagnetic stirring device 100 according to this embodiment, unlike in the comparative example, the two magnetic pole portions 120 are arranged in the circumferential direction of the mold 30 for each of the outer side surfaces of the mold 30. Therefore, the magnetic field generated by each magnetic pole portion 120 may be weakened. As a result, the magnetic flux horizontally entering the mold plate from the magnetic pole portion 120 may be weakened, so that generation of the leakage flux may be suppressed. For this reason, it is considered that, in this embodiment, the vertical components of the electromagnetic force applied to the molten steel 2 in the mold 30 decrease from those in the comparative example.

Figure 12:
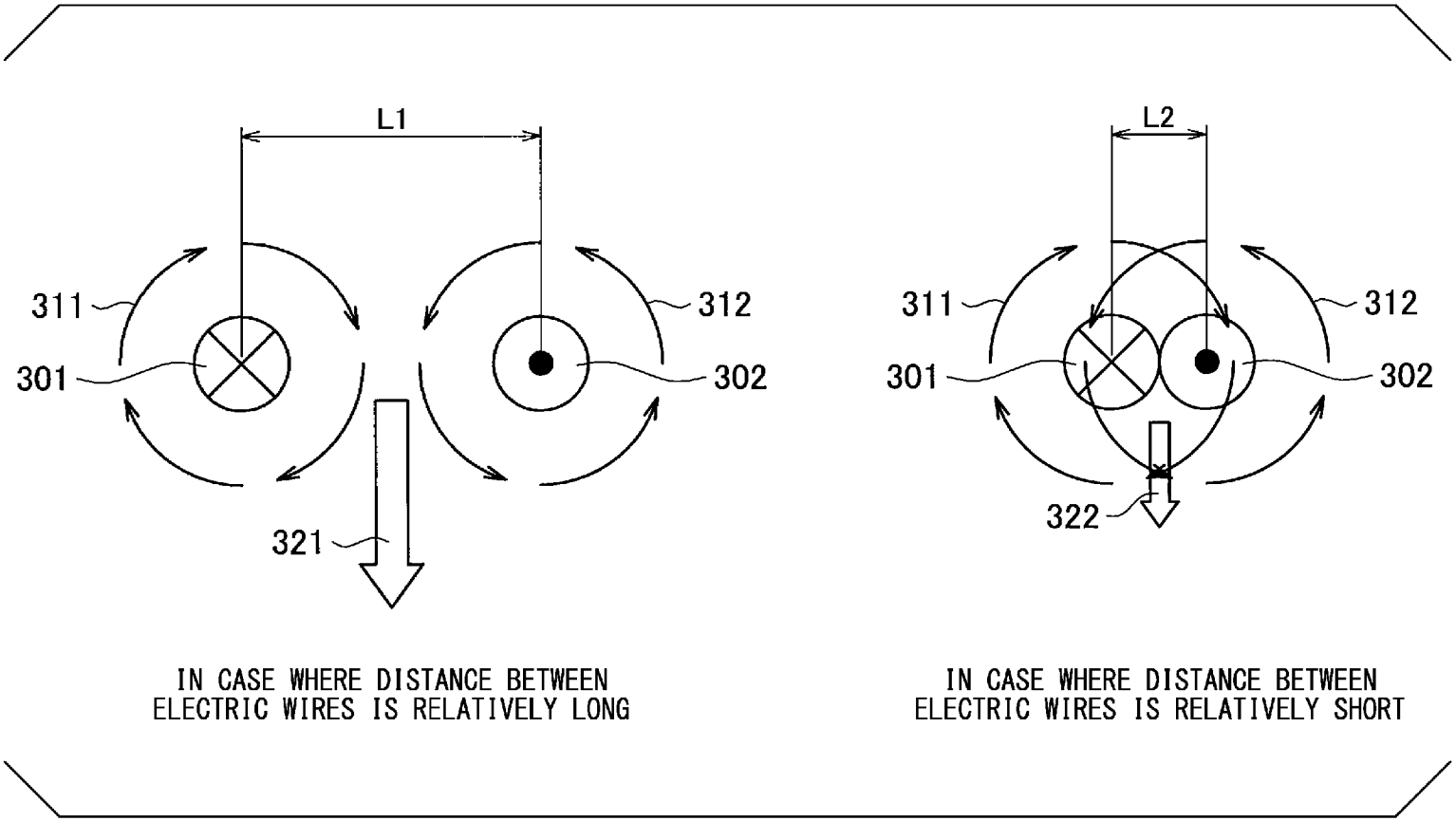
FIG. 12 is a view for explaining an interaction between adjacent magnetic fields.

Herein, an interaction between adjacent magnetic fields is described with reference to FIG. 12. FIG. 12 schematically illustrates electric wires 301 and 302 in which currents flow in opposite directions. A current flows in the electric wire 301 from a front side to a rear side of a paper surface. Therefore, a magnetic field 311 in a clockwise direction on the paper surface is generated around the electric wire 301. On the other hand, a current flows in the electric wire 302 from the rear side to the front side of the paper surface. Therefore, a magnetic field 312 in a counterclockwise direction on the paper surface is generated around the electric wire 302.

In a case where a distance between the electric wires 301 and 302 is a relatively long distance L1, the magnetic fields 311 and 312 reinforce each other between the electric wires 301 and 302, so that a magnetic flux 321 between the electric wires 301 and 302 becomes relatively strong. On the other hand, in a case where the distance between the electric wires 301 and 302 is a relatively short distance L2, the magnetic fields 311 and 312 cancel each other between the electric wires 301 and 302, so that a magnetic flux 322 between the electric wires 301 and 302 becomes relatively weak.

In this manner, in a case where the adjacent magnetic fields generated by the currents flowing in the opposite directions are relatively close to each other, there may be an effect that both the magnetic fields cancel each other. In the electromagnetic stirring device 100 according to this embodiment, as compared with the comparative example, the width in the circumferential direction of the mold 30 of each magnetic pole portion 120 is small, and the distance between the currents flowing in the opposite directions in the coils 130 is short, so that the adjacent magnetic fields cancel each other. Therefore, the magnetic flux entering the mold plate from each magnetic pole portion 120 becomes weak. Therefore, the eddy current generated in the mold plate becomes small. Furthermore, as for a range of the eddy current generated in the mold plate also, the width in the circumferential direction of the mold 30 is small, and the distance between the currents flowing in the opposite directions in each eddy current is short, so that there may be an effect that the adjacent magnetic fields cancel each other. As a result, there may be an effect of making the magnetic flux generated by the eddy current significantly weak. As a result, generation of the leakage flux may be suppressed. For this reason also, in this embodiment, it is considered that the vertical components of the electromagnetic force applied to the molten steel 2 in the mold 30 decrease from those in the comparative example.

Meanwhile, it is expected that the smaller the width in the circumferential direction of the mold 30 of each magnetic pole portion 120, the more the effect of weakening the magnetic flux generated by the eddy current generated in the mold plate is improved. However, the magnetic field which may be generated by one magnetic pole portion 120 becomes excessively weak due to small dimension of each magnetic pole portion 120, so that there is a case where it becomes difficult to secure the electromagnetic force applied to the molten steel 2. For example, in a case where three or more magnetic pole portions 120 are arranged in the circumferential direction of the mold 30 for each of the outer side surfaces of the mold 30, it might be difficult to secure the electromagnetic force applied to the molten steel 2. On the other hand, in this embodiment in which the two magnetic pole portions 120 are arranged in the circumferential direction of the mold 30 for each of the outer side surfaces of the mold 30, as described with reference to FIG. 7, it was confirmed that the electromagnetic force was distributed so as to generate the swirling flow around the vertical axis in the molten steel 2 in the mold 30.

As described above, according to the electromagnetic stirring device 100 of this embodiment, it is possible to apply the electromagnetic force to the molten steel 2 in the mold 30 so as to generate the swirling flow around the vertical axis. Furthermore, the vertical components of the electromagnetic force applied to the molten steel 2 in the mold 30 may be decreased. Therefore, it becomes possible to eliminate the need for a step of winding the coil around the iron core around the axis in the same direction as the direction in which the iron core forming the closed loop extends at the time of manufacturing, and appropriately generate the swirling flow around the vertical axis while suppressing the flow in the vertical direction in the molten steel 2 in the mold 30.

(Simulation 2)

Next, regarding each of this embodiment and the comparative example, an electromagnetic field analysis simulation was performed while variously changing the current frequency of the alternating current applied to the coil from the above-described simulation conditions.

Figure 13:
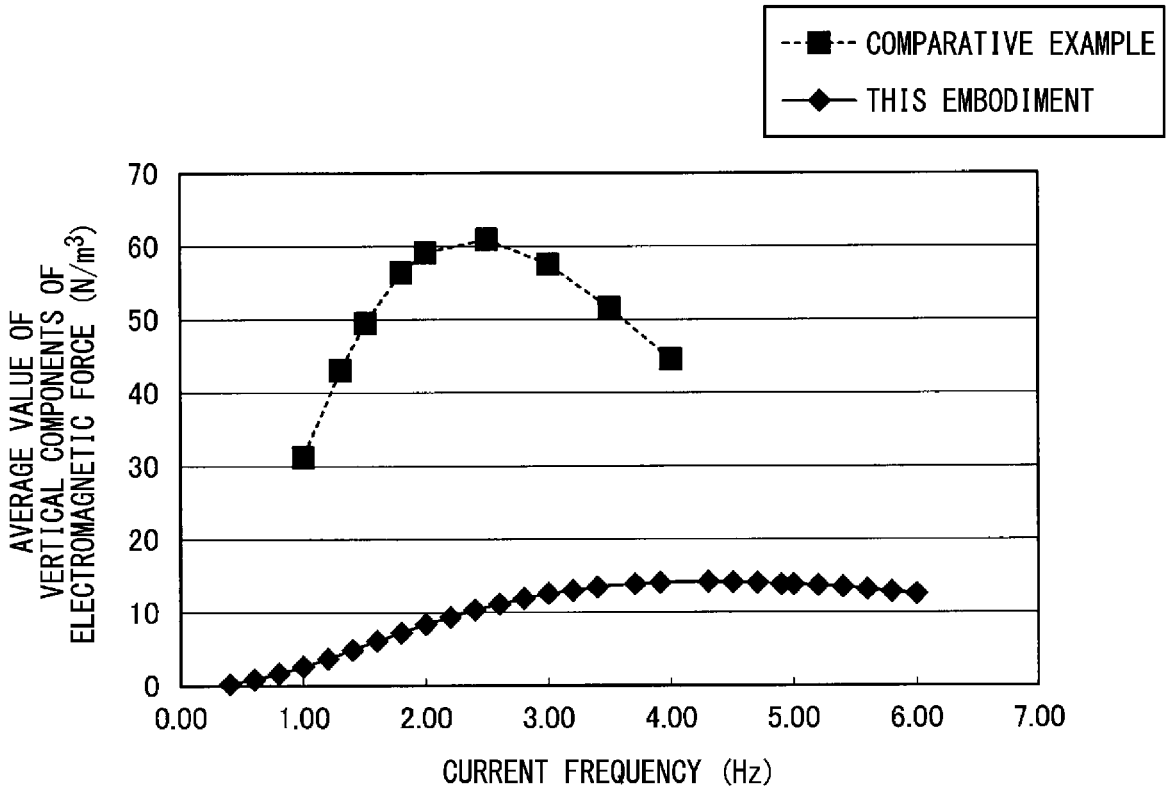
FIG. 13 is a view illustrating an example of a relationship between a current frequency and an average value of vertical components of the electromagnetic force applied to the molten steel in the mold obtained by the electromagnetic field analysis simulation regarding each of this embodiment and the comparative example.
Figure 14:
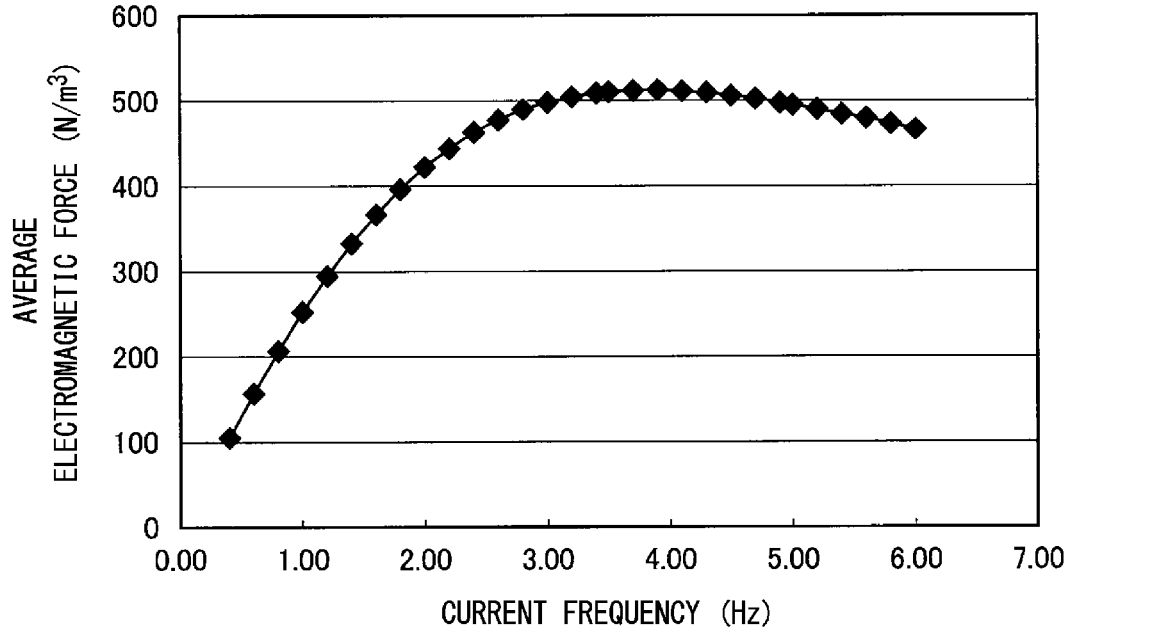
FIG. 14 is a view illustrating an example of a relationship between a current frequency and an average electromagnetic force applied to the molten steel in the mold obtained by the electromagnetic field analysis simulation regarding this embodiment.

Results of the electromagnetic field analysis simulation are illustrated in FIGS. 13 and 14 and Table 1. FIG. 13 is a view illustrating an example of a relationship between the current frequency and the average value of the vertical components of the electromagnetic force applied to the molten steel 2 in the mold 30 obtained by the electromagnetic field analysis simulation regarding each of this embodiment and the comparative example. FIG. 14 is a view illustrating an example of a relationship between the current frequency and an average electromagnetic force applied to the molten steel 2 in the mold 30 obtained by the electromagnetic field analysis simulation regarding this embodiment. Table 1 illustrates the average value of the vertical components of the electromagnetic force and a value of the average electromagnetic force for each current frequency obtained by the electromagnetic field analysis simulation regarding this embodiment. Meanwhile, the average electromagnetic force corresponds to an average value of absolute values (magnitude) of the electromagnetic force applied to the molten steel 2.

TABLE 1

| Current frequency (Hz) | Average value of vertical components of electromagnetic force ($N/m^3$) | Average electromagnetic force ($N/m^3$) |
|---|---|---|
| 0.4 | 0.5 | 108.7 |
| 0.6 | 1.1 | 160.7 |
| 0.8 | 1.9 | 210.1 |
| 1.0 | 2.9 | 256.2 |
| 1.2 | 4.0 | 298.6 |
| 1.4 | 5.1 | 336.8 |
| 1.6 | 6.3 | 370.9 |
| 1.8 | 7.5 | 400.7 |
| 2.0 | 8.6 | 426.4 |
| 2.2 | 9.6 | 448.2 |
| 2.4 | 10.6 | 466.3 |
| 2.6 | 11.4 | 481.0 |
| 2.8 | 12.2 | 492.7 |
| 3.0 | 12.8 | 501.7 |
| 3.2 | 13.3 | 508.2 |
| 3.4 | 13.7 | 512.6 |
| 3.7 | 14.1 | 515.7 |
| 3.9 | 14.3 | 515.9 |
| 4.1 | 14.4 | 505.0 |
| 4.3 | 14.4 | 512.7 |
| 4.5 | 14.4 | 509.6 |
| 4.7 | 14.3 | 505.8 |
| 4.9 | 14.1 | 501.3 |
| 5.0 | 14.1 | 498.5 |
| 5.2 | 13.9 | 493.6 |
| 5.4 | 13.6 | 488.1 |
| 5.6 | 13.4 | 482.9 |
| 5.8 | 13.1 | 476.1 |
| 6.0 | 12.9 | 469.8 |

With reference to FIG. 13, it was confirmed that, in this embodiment, the average value of the vertical components of the electromagnetic force became lower than that in the comparative example for each current frequency. From this, it is understood that, in this embodiment, the vertical components of the electromagnetic force applied to the molten steel 2 in the mold 30 decrease from those in the comparative example regardless of the current frequency.

With reference to FIG. 13 and Table 1, it is understood that the average value of the vertical components of the electromagnetic force basically becomes smaller as the current frequency becomes lower. Herein, the lower the current frequency is, the weaker the magnetic field generated by the magnetic pole portion 120, so that the weaker the magnetic flux horizontally entering the mold plate from the magnetic pole portion 120. Therefore, generation of the leakage flux in the magnetic field generated by the magnetic pole portion 120 is suppressed. Therefore, it is considered that the average value of the vertical components of the electromagnetic force becomes smaller as the current frequency becomes lower.

Meanwhile, in this embodiment, it is understood that the average value of the vertical components of the electromagnetic force takes a maximum value in a case where the current frequency is in the vicinity of 4.3 Hz, and gradually becomes smaller as the current frequency becomes higher in a region where the current frequency exceeds the vicinity of 4.3 Hz. Herein, in a case where the current frequency is relatively high, due to an increase in the effect that the magnetic flux horizontally entering the mold plate from the magnetic pole portion 120 is weakened by the eddy current generated in the mold plate, the magnetic flux which passes through the mold plate to reach the inside of the mold from the magnetic pole portion 120 decreases. As a result, it is considered that the average value of the vertical components of the electromagnetic force gradually decreases as the current frequency becomes higher in the region where the current frequency is high to exceed the vicinity of 4.3 Hz.

With reference to FIG. 14 and Table 1, it is understood that the average electromagnetic force basically becomes smaller as the current frequency becomes lower. It is considered that this is because the magnetic field generated by the magnetic pole portion 120 becomes weaker as the current frequency becomes lower, as described above.

Meanwhile, in this embodiment, it is understood that the average electromagnetic force takes a maximum value in a case where the current frequency is in the vicinity of 3.9 Hz, and gradually becomes smaller as the current frequency becomes higher in a region where the current frequency exceeds the vicinity of 3.9 Hz. It is considered that this is because the magnetic flux which passes through the mold plate to reach the inside of the mold from the magnetic pole portion 120 decreases in the region where the current frequency is high to exceed the vicinity of 3.9 Hz, as described above.

As described above, as the current frequency becomes lower, the average value of the vertical components of the electromagnetic force decreases, so that the effect of suppressing the flow in the vertical direction generated in the molten steel 2 in the mold 30 increases. On the other hand, since the average electromagnetic force decreases as the current frequency becomes lower, the effect of stirring the molten steel 2 by generating the swirling flow in the molten steel 2 in the mold 30 becomes smaller. In this manner, there is a trade-off relationship between the effect of suppressing the flow in the vertical direction generated in the molten steel 2 and the effect of generating the swirling flow in the molten steel 2 to stir the molten steel 2.

EXAMPLE 2

A result of an actual machine test performed to confirm a quality of a bloom manufactured in this embodiment is described. Specifically, an electromagnetic stirring device having a similar configuration as that of the electromagnetic stirring device 100 according to this embodiment described above was installed in a continuous casting machine actually used in operation (having a similar configuration as that of the continuous casting machine 1 illustrated in FIG. 1), and continuous casting was performed while variously changing a value of a current frequency of an alternating current applied to a coil 130. A surface quality and an internal quality of a bloom obtained after casting were examined by visual inspection and ultrasonic flaw detection inspection. Conditions for continuous casting are as follows.

Width X11 in long side direction of bloom: 456 mm

Width Y11 in short side direction of bloom: 339 mm

Thickness T11 of mold plate: 25 mm

Width X1 in long side direction of long side teeth: 240 mm

Width Y1 in short side direction of short side teeth: 190 mm

Interval X2 between long side teeth: 140 mm

Interval Y2 between short side teeth: 140 mm

Interval X3 between magnetic pole portions facing each other in mold long side direction: 775 mm Interval Y3 between magnetic pole portions facing each other in mold short side direction: 670 mm Distance Z1 in vertical direction between upper surface of teeth and bath level of molten steel: 280 mm.

Distance Z2 in vertical direction between lower surface of teeth and bath level of molten steel: 580 mm.

Winding in coil: 36 turns

Current value (effective value) of alternating current applied to coil: 640 A

Distance Z11 in vertical direction between bottom surface of immersion nozzle 6 and bath level of molten steel 2: 250 mm Inner diameter D11 of immersion nozzle 6: 90 mm Outer diameter D12 of immersion nozzle 6: 145 mm Height Z12 from bottom of discharge hole 61 of immersion nozzle 6: 85 mm Width D13 of discharge hole 61 of immersion nozzle 6: 80 mm Inclination of discharge hole 61 of immersion nozzle 6: 15° upward from inner side toward outer side of nozzle Table 2 illustrates a result of the actual machine test. In Table 2, a quality of the bloom is represented by "○" in a case where a defect was almost not found and maintenance was not required, "Δ" in a case where a defect was found and maintenance was required, and "×" in a case where many defects were found and not usable as a severe-quality material even after maintenance.

TABLE 2

| | Bloom quality | |
|---|---|---|
| Current frequency (Hz) | Surface quality | Inner quality |
| 0.4 | x | x |
| 0.6 | x | Δ |
| 0.8 | Δ | ○ |
| 1.0 | ○ | ○ |
| 1.2 | ○ | ○ |
| 1.4 | ○ | ○ |
| 1.6 | ○ | ○ |
| 1.8 | ○ | ○ |
| 2.0 | ○ | ○ |
| 2.2 | ○ | ○ |
| 2.4 | ○ | ○ |
| 2.6 | ○ | ○ |
| 2.8 | ○ | ○ |
| 3.0 | ○ | ○ |
| 3.2 | ○ | ○ |
| 3.4 | ○ | ○ |
| 3.7 | ○ | ○ |
| 3.9 | ○ | ○ |
| 4.1 | ○ | ○ |
| 4.3 | ○ | ○ |
| 4.5 | ○ | ○ |
| 4.7 | ○ | ○ |
| 4.9 | ○ | ○ |
| 5.0 | ○ | ○ |
| 5.2 | ○ | ○ |
| 5.4 | ○ | ○ |
| 5.6 | ○ | ○ |
| 5.8 | ○ | ○ |
| 6.0 | ○ | ○ |

With reference to Table 2, it was confirmed that the quality of the bloom was excellent in terms of both the surface quality and internal quality in a case where the current frequency was 1.0 Hz to 6.0 Hz. Therefore, it is understood that the quality of the bloom may be effectively improved by applying the alternating current of 1.0 Hz to 6.0 Hz to the coil 130. It is considered that this is because both the effect of suppressing the flow in the vertical direction generated in the molten steel 2 and the effect of stirring the molten steel 2 by generating the swirling flow to the molten steel 2 may be effectively obtained in a case where the current frequency is 1.0 Hz to 6.0 Hz.

By the way, the average electromagnetic force applied to the molten steel 2 in the mold 30 gradually becomes smaller as the current frequency becomes higher in the region where the current frequency exceeds the vicinity of 3.9 Hz as described above. In addition, power consumption in the electromagnetic stirring device 100 increases as the current frequency becomes higher, so that there is no advantage of making the current frequency higher than 4.0 Hz. Therefore, it is possible to suppress the power consumption while effectively improving the quality of the bloom by applying the alternating current of 1.0 Hz to 4.0 Hz to the coil 130.

EXAMPLE 3

A result of a heat flow analysis simulation performed for confirming in further detail the flow generated in the molten steel 2 in the mold 30 in this embodiment is described.

(Simulation 1)

Using a result of distribution of the electromagnetic force applied to the molten steel 2 obtained by the above-described electromagnetic field analysis simulation for the electromagnetic stirring device 100 according to this embodiment performed while setting the current frequency to 1.2 Hz, the heat flow analysis was performed.

Conditions of the heat flow analysis simulation regarding this embodiment are as follows.

Width X11 in long side direction of bloom: 456 mm

Width Y11 in short side direction of bloom: 339 mm

Figure 15:
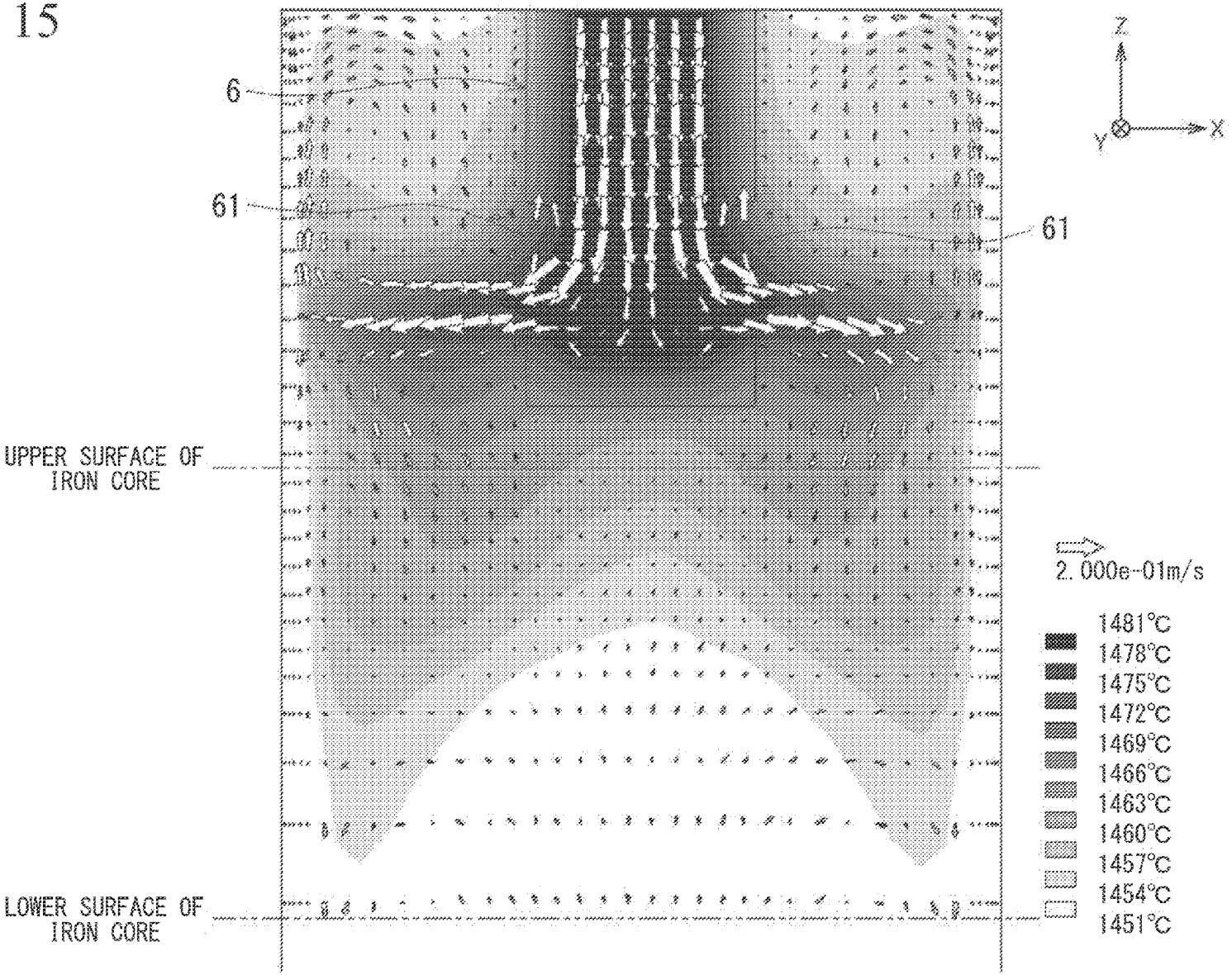
FIG. 15 is a view illustrating an example of distribution of temperature and a stirring flow rate of the molten steel in the mold in a cross-section passing through a center line of an immersion nozzle and parallel to a mold long side direction obtained by a heat flow analysis simulation regarding this embodiment.
Figure 16:
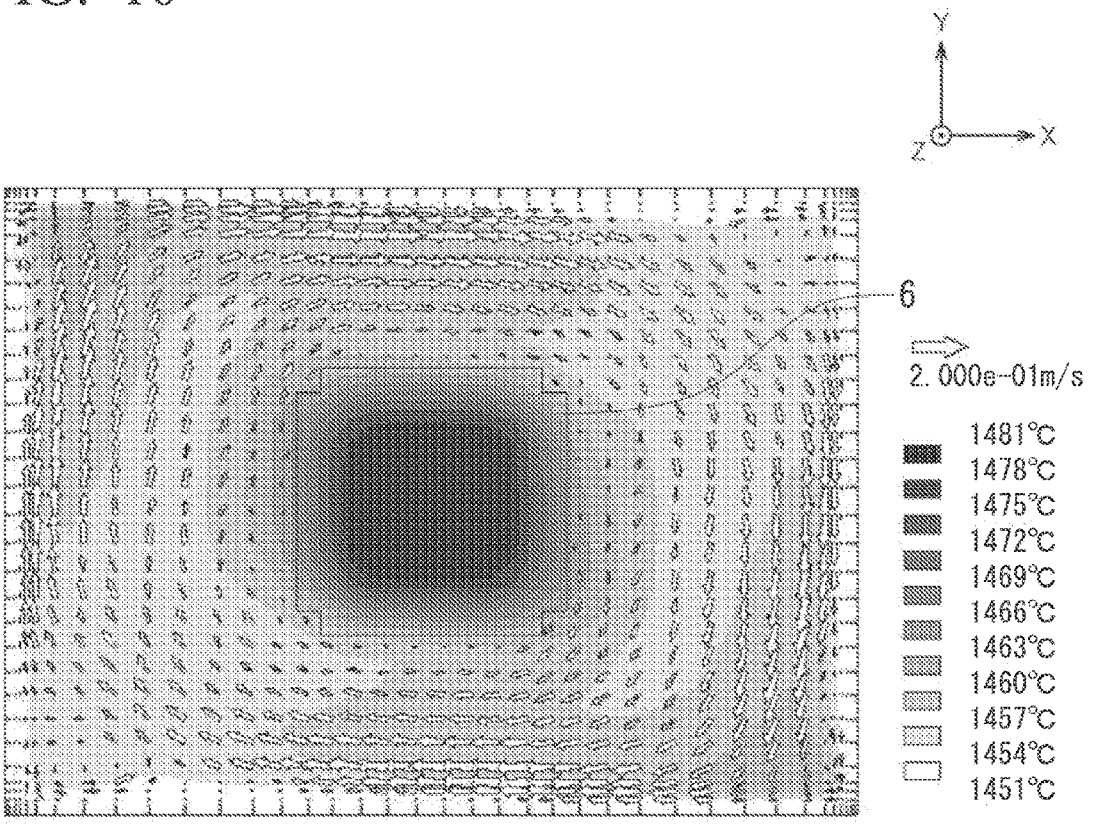
FIG. 16 is a view illustrating an example of distribution of the temperature and stirring flow rate of the molten steel in the mold in a horizontal plane apart from a bath level downward by 50 mm obtained by the heat flow analysis simulation regarding this embodiment.
Figure 17:
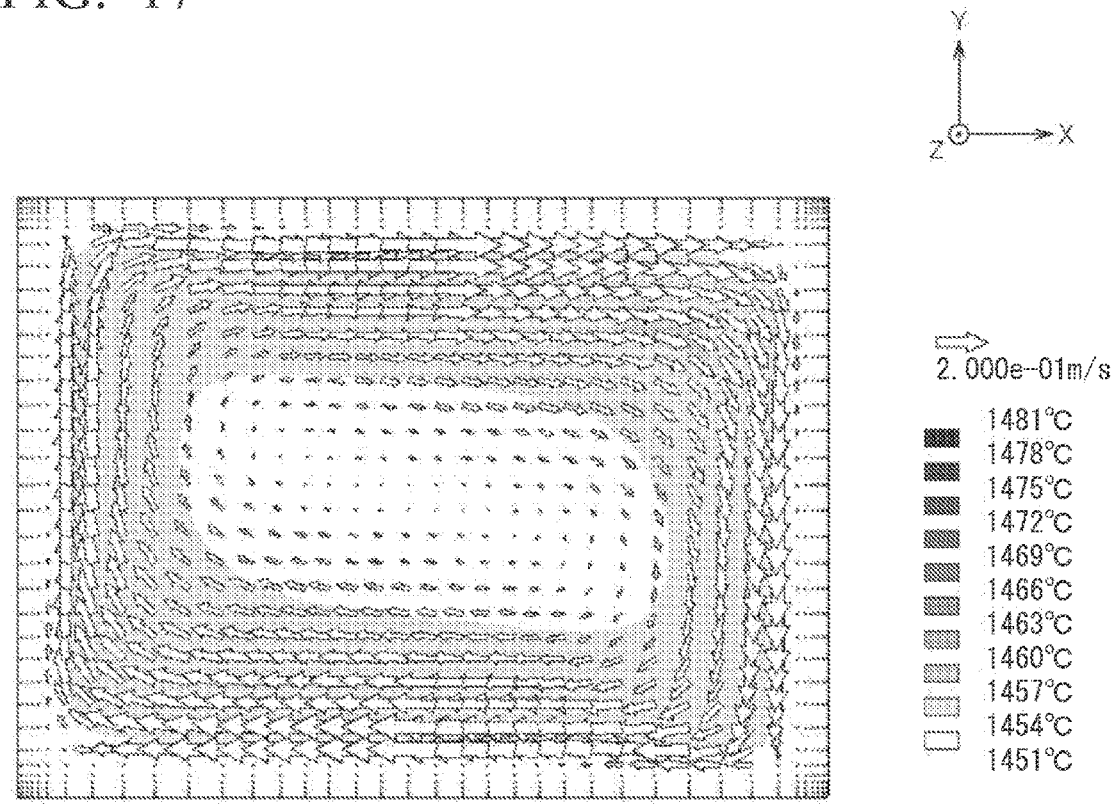
FIG. 17 is a view illustrating an example of distribution of the temperature and stirring flow rate of the molten steel in the mold in a horizontal plane apart from the bath level downward by 430 mm obtained by the heat flow analysis simulation regarding this embodiment.

Distance Z11 in vertical direction between bottom surface of immersion nozzle 6 and bath level of molten steel 2: 250 mm Inner diameter D11 of immersion nozzle 6: 90 mm Outer diameter D12 of immersion nozzle 6: 145 mm Height Z12 from bottom of discharge hole 61 of immersion nozzle 6: 85 mm Width D13 of discharge hole 61 of immersion nozzle 6: 80 mm Inclination of discharge hole 61 of immersion nozzle 6: 15° upward from inner side toward outer side of nozzle Casting speed (speed at which bloom is pulled out): 0.6 m/min Results of the above-described heat flow analysis simulation are illustrated in FIGS. 15 to 17. FIG. 15 is a view illustrating an example of distribution of temperature and a stirring flow rate of the molten steel 2 in the mold 30 in a cross-section passing through a center line of the immersion nozzle 6 and parallel to the mold long side direction obtained by the heat flow analysis simulation regarding this embodiment. FIG. 16 is a view illustrating an example of distribution of the temperature and stirring flow rate of the molten steel 2 in the mold 30 in a horizontal plane (horizontal plane above steel iron core 110) apart from the bath level downward by 50 mm obtained by the heat flow analysis simulation regarding this embodiment. FIG. 17 is a view illustrating an example of distribution of the temperature and stirring flow rate of the molten steel 2 in the mold 30 in a horizontal plane (horizontal plane in a center position in vertical direction of steel iron core 110) apart from the bath level downward by 430 mm obtained by the heat flow analysis simulation regarding this embodiment. In FIGS. 15 to 17, a flux vector representing a flow rate (m/s) in each position of the molten steel 2 as a vector amount is indicated by an arrow. In FIGS. 15 to 17, temperature distribution is illustrated by grayscale gradation, and a darker portion indicates a region at higher temperature.

With reference to FIG. 15, a state in which the molten steel 2 sent into the mold 30 through the immersion nozzle 6 is horizontally discharged from the discharge hole 61 is confirmed. With reference to FIGS. 16 and 17, a state in which the molten steel 2 is discharged from the discharge hole 61 and then stirred around the vertical axis is confirmed. Specifically, with reference to FIG. 17, a state in which the swirling flow around the vertical axis is generated in the molten steel 2 in the mold 30 in the horizontal plane in the center position in the vertical direction of the iron core 110 is confirmed. Furthermore, with reference to FIG. 16, a state in which the swirling flow around the vertical axis is generated in the molten steel 2 in the mold 30 also in the horizontal plane above the iron core 110 is similarly confirmed.

As described above, according to the electromagnetic stirring device 100 of this embodiment, it was confirmed in further detail that it is possible to appropriately generate the swirling flow around the vertical axis in the molten steel 2 in the mold 30.

(Simulation 2)

Next, a heat flaw analysis simulation using each of the results of the electromagnetic field analysis simulation regarding this embodiment performed while variously changing the current frequency was performed. Specifically, the heat flow analysis simulation using each of results of the electromagnetic field analysis simulation regarding this embodiment in a case where the current frequency was set to 1.0 Hz, 1.8 Hz, 2.5 Hz, and 4.0 Hz was performed. Meanwhile, as a comparison target, a heat flow analysis simulation using the results of the electromagnetic field analysis simulation regarding the comparative example performed while setting the current frequency to 1.8 Hz was also performed.

Figure 18:
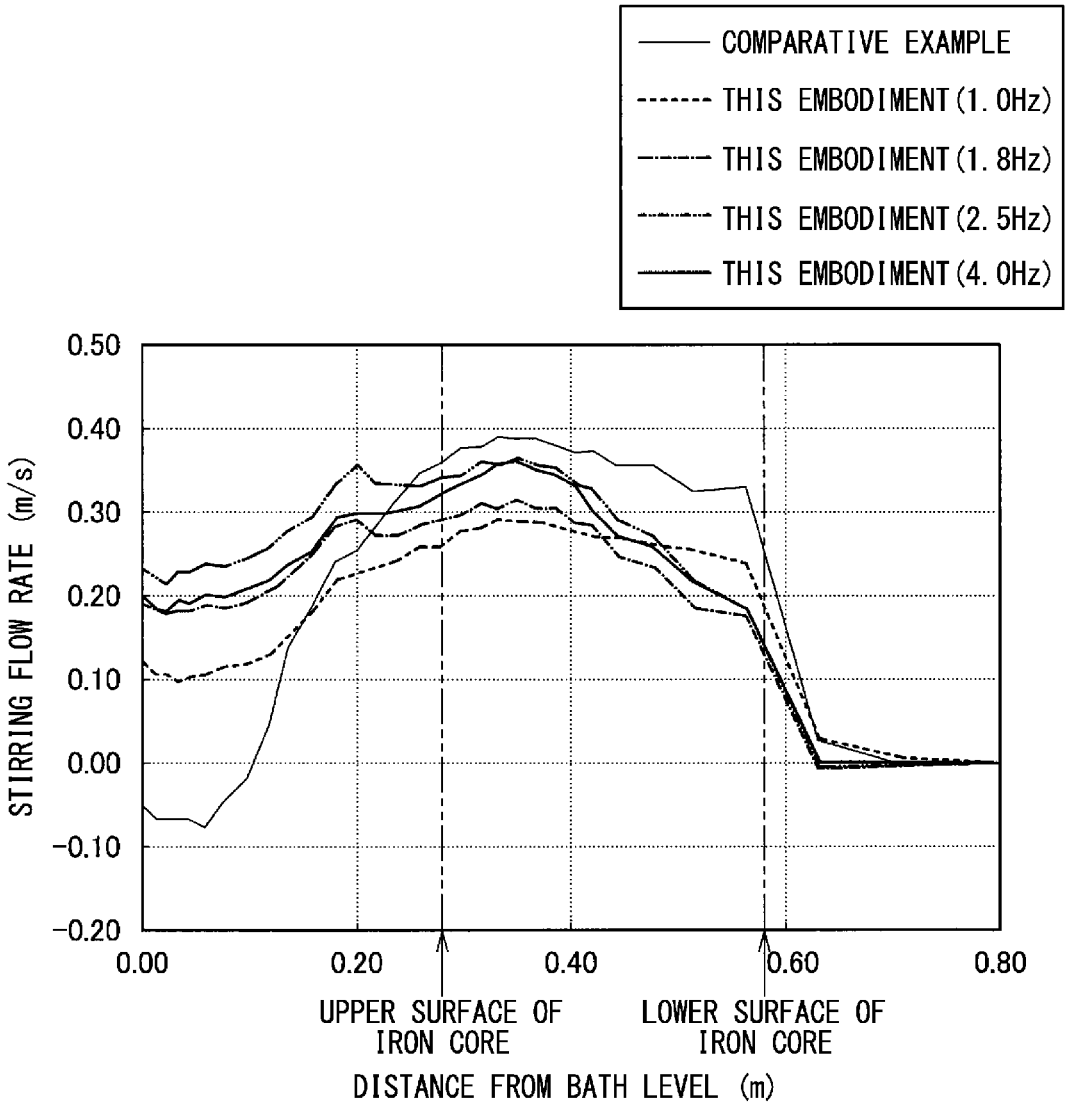
FIG. 18 is a view illustrating an example of a relationship between a distance from the bath level and the stirring flow rate of the molten steel in the mold obtained by the heat flow analysis simulation regarding each of this embodiment and the comparative example.

Results of the heat flow analysis simulations are illustrated in FIG. 18. FIG. 18 is a view illustrating an example of a relationship between the distance from the bath level and the stirring flow rate of the molten steel 2 in the mold 30 obtained by the heat flow analysis simulation regarding each of this embodiment and the comparative example. Specifically, FIG. 18 illustrates the result regarding this embodiment and the result regarding the comparative example in a case where the current frequency is set to 1.0 Hz, 1.8 Hz, 2.5 Hz, and 4.0 Hz. In FIG. 18, a case where the stirring flow rate takes a negative value corresponds to a case where the molten steel 2 flows in a direction opposite to a rotating direction of the rotating magnetic field generated by the electromagnetic stirring device.

Regarding this embodiment, with reference to FIG. 18, it is confirmed that the stirring flow rate of 0.15 m/s to 0.4 m/s occurs in a region between the upper surface and the lower surface of the iron core at each current frequency. Furthermore, it is confirmed at each current frequency that the stirring flow rate of 0.1 m/s to 0.35 m/s occurs in a region above the iron core.

On the other hand, regarding the comparative example, with reference to FIG. 18, it is confirmed that the stirring flow rate of 0.15 m/s to 0.4 m/s occurs in a region between the upper surface and the lower surface of the iron core. However, in a region above the iron core, it is confirmed that the stirring flow rate is significantly slower than that in this embodiment. Especially, it is confirmed that the stirring flow rate turns to a negative value in a region in the vicinity of the bath level. It is considered that this is because, in the comparative example, the flow in the vertical direction is relatively easily generated in the molten steel 2, so that the swirling flow around the vertical axis was suppressed by the flow in the vertical direction of the molten steel 2.

As described above, in this embodiment, it was confirmed that the stirring flow rate may be sufficiently generated in the molten steel 2 also in the region above the iron core 110 in the mold 30. In this manner, in this embodiment, it was confirmed that the swirling flow around the vertical axis may be appropriately generated in the molten steel 2 in the mold 30. Especially, it was confirmed that the swirling flow around the vertical axis may be appropriately generated in the molten steel 2 in the mold 30 in a case where an alternating current of 1.0 Hz to 4.0 Hz was applied to the coil 130.

<4. Summary>

As described above, in the electromagnetic stirring device 100 according to this embodiment, the iron core 110 includes, for each of the outer side surfaces of the mold 30, the two teeth 119 arranged side by side in the circumferential direction of the mold 30 so as to face the outer side surface. Therefore, in the electromagnetic stirring device 100 according to this embodiment, two magnetic pole portions 120 each of which is formed of the teeth 119 of the iron core 110 and the coil 130 wound around the teeth 119 are arranged in the circumferential direction of the mold 30 for each of the outer side surfaces of the mold 30. As a result, it is possible to obtain an effect of significantly weakening the magnetic flux generated by the eddy current generated in the mold plate by the magnetic flux entering the mold plate from the magnetic pole portion 120. Therefore, generation of the leakage flux may be suppressed. Therefore, it is possible to apply the electromagnetic force to the molten steel 2 so as to generate the swirling flow around the vertical axis while decreasing the vertical component of the electromagnetic force applied to the molten steel 2 in the mold 30. Therefore, it becomes possible to eliminate the need for a step of winding the coil around the iron core around the axis in the same direction as the direction in which the iron core forming the closed loop extends at the time of manufacturing, and appropriately generate the swirling flow around the vertical axis while suppressing the flow in the vertical direction in the molten steel 2 in the mold 30.

The preferred embodiment of the present invention is described above in detail with reference to the accompanying drawings, but the present invention is not limited to such example. It is obvious that one of ordinary knowledge in the technical field to which the present invention belongs may achieve various variations or applications within the scope of the technical idea recited in claims, and, it is understood that they naturally belong to the technical scope of the present invention.

FIELD OF INDUSTRIAL APPLICATION

According to the present invention, it is possible to provide the electromagnetic stirring device capable of appropriately generating the swirling flow around the vertical axis while suppressing the flow in the vertical direction in the molten metal in the mold in which the need for a step of winding the coil around the iron core around the axis in the same direction as the direction in which the iron core forming the closed loop extends at the time of manufacturing is eliminated.

BRIEF DESCRIPTION OF THE REFERENCE SYMBOLS

1 Continuous casting machine
2 Molten steel
3 Bloom
3*a* Solidified shell
3*b* Unsolidified portion
4 Ladle
5 Tundish
6 Immersion nozzle
7 Secondary cooling device
8 Bloom cutter
9 Secondary cooling zone
11 Support roll
12 Pinch roll
13 Segment roll
14 Bloom
15 Table roll
30 Mold
31, 33 Long side mold plate
32, 34 Short side mold plate
61 Discharge hole
100 Electromagnetic stirring device
110 Iron core
111, 113 Long side main body
112, 114 Short side main body
119 Teeth

120 Magnetic pole portion
130 Coil
150 Power supply device
170 Case

What is claimed is:

1. An electromagnetic stirring device for continuous casting comprising:

a mold;

an iron core configured to enclose the mold at a side of the mold and including four main bodies, each of the four main bodies arranged to face a respective one of each of outer side surfaces of the mold and two teeth arranged side by side along a circumferential direction of the mold in each of the four main bodies;

coils wound around the respective teeth of the iron core; and a power supply device configured to apply two-phase alternating currents of +U, +V, −U, −V, +U, +V, −U and −V in a counterclockwise direction to each of the coils with a phase shift by 90° in an arrangement order of the coils, respectively, so as to generate a rotating magnetic field, where U and V are different from each other.

2. The electromagnetic stirring device according to claim 1, wherein the power supply device applies an alternating current of 1.0 Hz to 4.0 Hz to each of the coils.

* * * * *